US007087007B2

(12) United States Patent
Iwama

(10) Patent No.: US 7,087,007 B2
(45) Date of Patent: Aug. 8, 2006

(54) SHEET POST-PROCESSING DEVICE AND IMAGE FORMING APPARATUS

(75) Inventor: Satoshi Iwama, Yamanashi-ken (JP)

(73) Assignee: Nisca Corporation, Yamanashi-Ken (JP)

( * ) Notice: Subject to any disclaimer, the term of this patent is extended or adjusted under 35 U.S.C. 154(b) by 0 days.

(21) Appl. No.: 10/445,077

(22) Filed: May 27, 2003

(65) Prior Publication Data

US 2003/0222391 A1 Dec. 4, 2003

(30) Foreign Application Priority Data

May 28, 2002 (JP) ..... 2002-154126

(51) Int. Cl.
*B31F 1/10* (2006.01)
*B31F 7/00* (2006.01)

(52) U.S. Cl. ..... 493/444; 493/416; 493/442; 493/445

(58) Field of Classification Search ..... 493/405, 493/416, 442, 443, 444, 445
See application file for complete search history.

(56) References Cited

U.S. PATENT DOCUMENTS

| | | | | |
|---|---|---|---|---|
| 411,151 | A * | 9/1889 | Kneeland | 493/445 |
| 1,501,774 | A * | 7/1924 | Heeter et al. | 493/356 |
| 1,693,147 | A * | 11/1928 | King | 270/45 |
| 4,717,375 | A * | 1/1988 | Lundmark | 493/360 |
| 4,781,667 | A * | 11/1988 | Kitai | 493/359 |
| 5,007,891 | A * | 4/1991 | von Hein | 493/444 |

FOREIGN PATENT DOCUMENTS

JP 10-245153 9/1998

* cited by examiner

*Primary Examiner*—Louis K. Huynh
*Assistant Examiner*—Christopher R. Harmon
(74) *Attorney, Agent, or Firm*—Manabu Kanesaka

(57) ABSTRACT

A sheet post-processing device is provided with a pushing device for pushing a predetermined position of a sheet stack in a direction substantially perpendicular to a direction that the sheet stack is conveyed, and a pair of rotating bodies for performing a folding operation. In the folding operation, a position of the sheet stack pushed by the pushing device is moved away from a contact point between rotational centers of the rotating bodies.

9 Claims, 18 Drawing Sheets

FIG. 17(A)
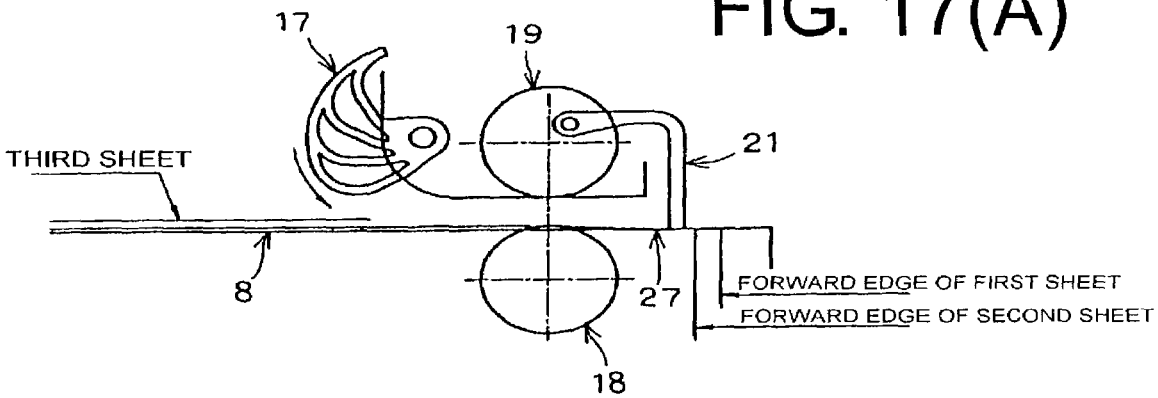
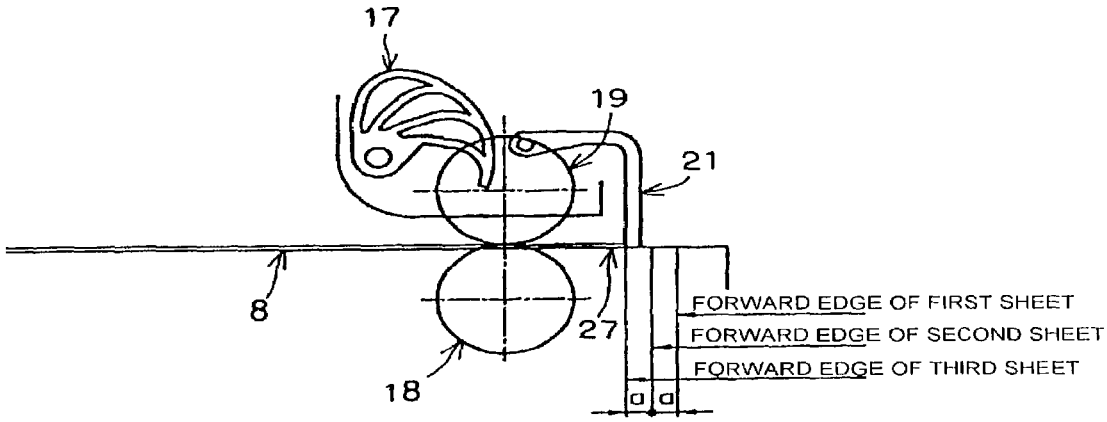
FIG. 17(B)

SHEET POST-PROCESSING DEVICE AND IMAGE FORMING APPARATUS

BACKGROUND OF THE INVENTION AND RELATED ART STATEMENT

The present invention relates to a sheet post-processing device and an image processing apparatus. More particularly, the present invention relates to a sheet post-processing device for performing a folding operation and a saddle stitching operation on a sheet stack discharged from an image forming apparatus and an image forming apparatus having such a sheet post-processing device.

Conventionally, an image forming apparatus such as a copier, printer, facsimile or a combination thereof, forms an image onto a sheet, and is equipped with a sheet post-processing device mountable to the image forming apparatus. A certain type of sheet feeding apparatus folds discharged sheets to form a finished booklet with the edges of the sheets neatly aligned (or perform a binding process).

Such a sheet feeding apparatus performs the folding operation in which, for example, a folding blade pushes the sheet stack and rotating bodies such as folding rollers nip and fold the sheet stack.

However, in the conventional sheet feeding apparatus, when the folding blade pushes the sheet stack into a nipping point of the folding rollers, it is difficult to convey the sheet stack between the folding rollers, resulting in a folding jam, and the sheet stack is not folded.

Such a folding jam occurs when the folding rollers convey the sheet stack with an insufficient force. Also, the nipping point of the folding rollers for folding the sheet stack is fixed at a constant position. Therefore, when the folding blade does not push the sheet stack into the nipping point of the folding rollers with a sufficient force, the sheet stack tends to stay at a position away from the folding rollers.

Accordingly, it is an object of the present invention to provide a sheet post-processing apparatus for securely folding the sheet stack.

Further objects and advantages of the invention will be apparent from the following description of the invention.

SUMMARY OF THE INVENTION

In order to attain the aforementioned objectives, according to the first aspect of the present invention, a sheet post-processing device is provided with pushing means for pushing a predetermined position of a sheet stack comprising at least one sheet in a direction substantially perpendicular to a direction that the sheet stack is conveyed, and a pair of folding rotating bodies or rotatable bodies for performing a folding operation while a position of the sheet stack pushed by the pushing means where the folding rotating bodies apply the folding operation is moved away from a contact point between rotational centers of the folding rotating bodies.

In the first aspect of the present invention, the pushing means pushes the predetermined position of the sheet stack composed of at least one sheet in the direction substantially perpendicular to the direction that the sheet stack is conveyed. The pair of the folding rotating bodies performs the folding operation while the position of the sheet stack pushed by the pushing means where the folding rotating bodies apply the folding operation is moved away from the contact point between the rotational centers of the folding rotating bodies.

According to the first aspect, the position of the sheet stack pushed by the pushing means where the folding rotating bodies apply the folding operation is moved away from the contact point between the rotational centers of the folding rotating bodies. Therefore, it is easy to push (insert) the sheet stack between the pair of the folding rollers, so that the folding rollers can fold the sheet stack securely.

In the first aspect of the present invention, to securely pull the sheet stack in between the folding rollers, the folding position moves in a direction that the pushing means pushes the sheet stack. Specifically, it is arranged that at least one of the pair of the folding rotating bodies has at least two curved portions having different curve radii, and the pair of the folding rotating bodies is pivotally supported so that the distance between the rotational axes thereof is variable. Alternatively, at least one of the pair of the folding rotating bodies has a rotational axis located off the center thereof, and the pair of the folding rotating bodies is pivotally supported so that the distance between the rotational axes thereof is variable.

In order to solve the aforementioned problems, according to the second aspect of the present invention, a sheet post-processing device is provided with pushing means for pushing a predetermined position of a sheet stack comprising at least one sheet in a direction substantially perpendicular to a direction that the sheet stack is conveyed, and a pair of folding rotating bodies for performing a folding operation on the sheet stack pushed by the pushing means. At least one of the pair of the folding rotating bodies has at least two curved portions having different curve radii.

In the second aspect of the present invention, the pushing means pushes the predetermined position of the sheet stack comprising at least one sheet in the direction substantially perpendicular to the direction that the sheet stack is conveyed. The pair of the folding rotating bodies performs the folding operation on the sheet stack pushed by the pushing means. At least one of the pair of the folding rotating bodies has at least two curved portions having different curve radii.

In the second aspect, one of the folding rotating bodies has the curved portion having a curve radius larger than that of the other rotating body, and the pair of the folding rotating bodies nips the sheet stack. As a result, a distance between the folding rotating bodies becomes smaller with respect to the sheet stack pushed by the pushing means. Accordingly, the folding position moves from at the contact point between the rotational centers to the sheet stack. Therefore, it is possible to pull the sheet stack into the pair of the folding rollers more easily, and to securely fold the sheet stack. It is preferable that the pair of the folding rotating bodies is pivotally supported so that the distance between the rotational axes of the pair of folding rotating bodies is variable.

According to the third aspect of the present invention, an image forming apparatus comprises the sheet post-processing device of the first and second aspects.

BRIEF DESCRIPTION OF THE DRAWINGS

FIG. 7(A) and FIG. 7(B) are side views of a structure of a folding unit of the sheet post-processing apparatus, wherein FIG. 7(A) is a view showing an initial position of folding rollers, and FIG. 7(B) is a view showing a state that the folding rollers touch and nip a sheet stack at a portion having a maximum radius during a folding process;

FIGS. 13(A) and 13(B) are views of the folding unit in a saddle staple mode, wherein FIG. 13(A) is a side view of the folding unit in a state prior to a sheet stack folding operation, and FIG. 13(B) is a side view of the folding unit during the sheet stack folding operation;

FIGS. 15(A)–15(C) are views showing operations of an offset unit relative to the first sheet, wherein FIG. 15(A) is a view showing an operation No. 1, FIG. 15(B) is a view showing an operation No. 2, and FIG. 15(C) is a view showing an operation No. 3;

FIGS. 16(A)–16(C) are views showing operations of the offset unit relative to the second sheet continued from the first sheet, wherein FIG. 16(A) is a view showing an operation No. 4, FIG. 16(B) is a view showing an operation No. 5, and FIG. 16(C) is a view showing an operation No. 6;

FIGS. 17(A) and 17(B) are views showing operations of the offset unit relative to the third sheet continued from the second sheet, wherein FIG. 17(A) is a view showing an operation No. 7, and FIG. 17(B) is a view showing an operation No. 8; and FIGS. 18(A) and 18(B) are views of the folding unit in a offset saddle stitch mode and a offset saddle mode, wherein FIG. 18(A) is a side view of the folding unit in a state prior to the sheet stack folding operation, and FIG. 18(B) is a side view of the folding unit during the sheet stack folding operation.

DETAILED DESCRIPTION OF PREFERRED EMBODIMENTS

Hereunder, embodiments of the present invention will be explained with reference to the accompanying drawings.

Figure 1:
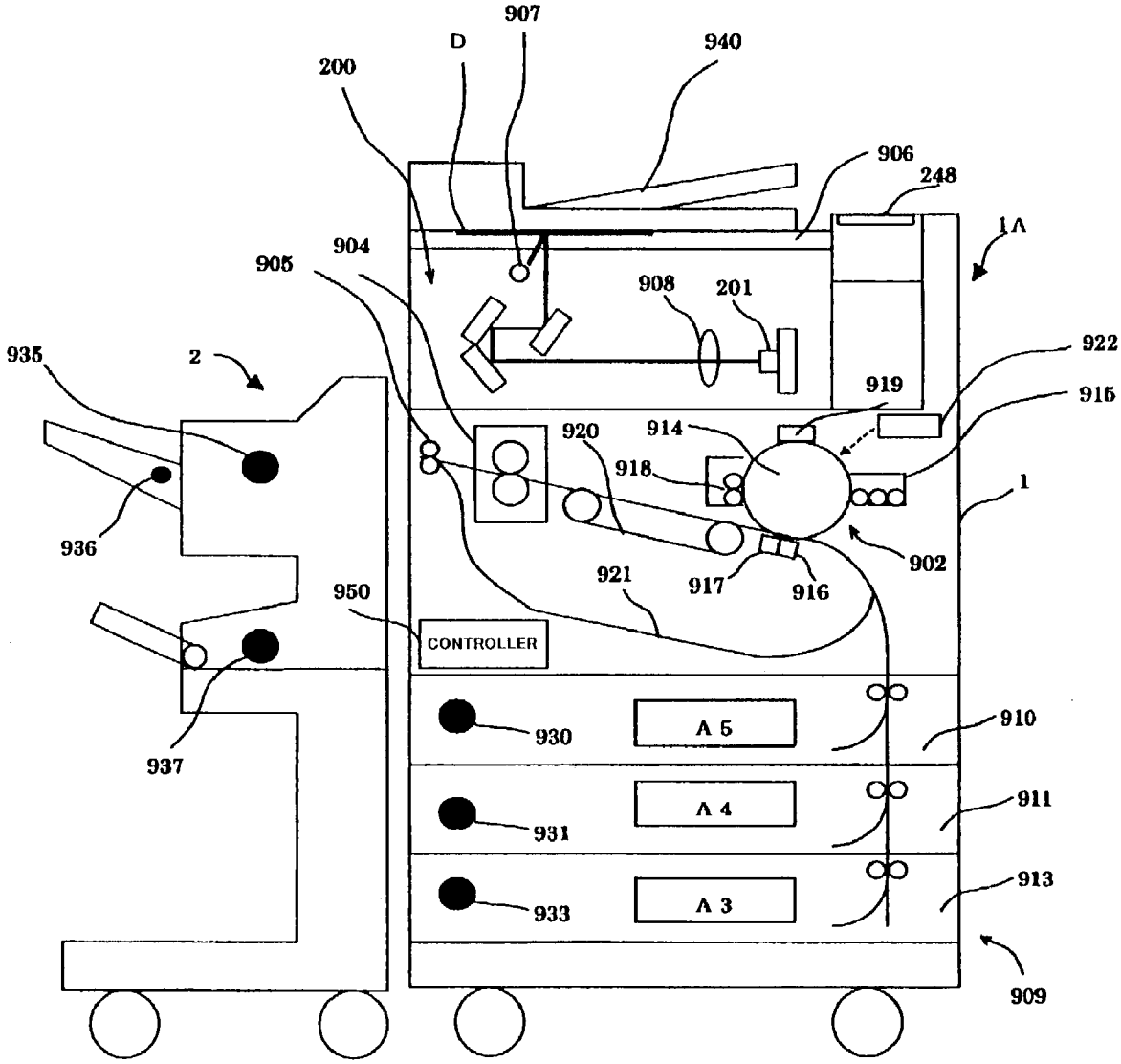
FIG. 1 is a side view of a copier according to the present invention.

As shown in FIG. 1, according to an embodiment of the present invention, a digital copying apparatus 1A includes a digital copying apparatus main unit 1 for forming an image on a sheet, and a sheet post-processing device 2 detachably mounted on the digital copying apparatus main unit 1 for performing a saddle stitching operation and a folding operation on sheets discharged from the digital copying apparatus main unit 1.

The digital copying apparatus main unit 1 includes an image forming assembly 902 for recording an image of an original document D on the sheet; an image input unit 200 provided as a so-called scanner for focusing light reflected from the original document D on a CCD 201 through an optical system 908 and having a light source 907 disposed above the image forming assembly 902 for emitting light toward the original document D; a sheet feeder 909 arranged below the image forming assembly 902 for feeding the sheets to the image forming assembly 902 one by one; and a controller 950 for controlling these components.

The sheet feeder 909 is detachably mounted on the digital copying apparatus main unit 1, and includes a cassette 910 for holding A5 size sheets, cassette 911 for holding A4 size sheets, and cassette 913 for holding A3 size sheets. The cassettes 910, 911 and 913 are respectively provided with an A5 size sheet cassette selection switch 930 for manually selecting the A5 size sheets, an A4 size sheet cassette selection switch 931 for manually selecting the A4 size sheets, and an A3 size sheet cassette selection switch 933 for manually selecting the A3 size sheets. It is possible to manually select a sheet size by pressing one of the switches arranged on the respective cassettes while visually checking the sheet size. It is also possible to select a sheet size through a touch panel 248 as described later.

The image forming assembly 902 includes a cylindrical photoconductive drum 914 for forming an electrostatic latent image on a circumference thereof. Arranged around the photoconductive drum 914 are a primary charging unit 919 for charging the photoconductive drum 914 for latent image formation; laser unit 922 for outputting a laser beam modulated in accordance with image data stored in a hard disk 961 (described later) to the photoconductive drum 914; a development unit 915 for developing the electrostatic latent image formed on the photoconductive drum 914 into a toner image; a transfer unit 916 for transferring the toner image onto the sheet; a separating charging unit 917 for charging the sheet in a polarity opposite to the transfer unit 916 to separates the sheet from the photoconductive drum 914; and a cleaner 918 for cleaning the photoconductive drum 914.

The laser unit 922 includes a semiconductor laser for generating a laser beam; a polygon mirror for converting the laser beam emitted from the semiconductor laser into a beam for a single scan line through a collimator lens; an fθ lens for collimating the laser beam for a scanning line from the polygon mirror; a mirror for guiding the collimated laser beam from the fθ lens to the photoconductive drum 914; and a motor for rotating the polygon mirror.

An endless conveyance belt 920 is wrapped and extended between rollers. One of the rollers is disposed at downstream of the photoconductive drum 914 and in the vicinity of the separating charging unit 917. The other of the rollers is disposed in the vicinity of a fixing unit 904 having a heater roller to heat and fix the toner image onto the sheet. A pair of discharge rollers 905 is arranged at downstream of the fixing unit 904 for discharging the sheet bearing an image thereon from the digital copying apparatus main unit 1. A duplexer 921 is arranged below the endless conveyance belt 920 between the discharge roller pair 905 and an upstream side of the photoconductive drum 914 for forming an image on the backside of the sheet with the image on the front side thereof for performing a both-side printing operation.

The digital copying apparatus main unit 1 also includes a platen glass 906 for receiving a document D thereon at an upper portion of the main unit, and a touch panel 248 for displaying a status of the digital copying apparatus 1A in accordance with information from the a controller 950 and for receiving a command to the controller 950 from an operator. An automatic document feeder (ADF) 940 is arranged above the platen glass 906 for automatically feeding the document D to the platen glass 906. One side of the ADF 940 is fixed to an upper portion of the digital copying apparatus main unit 1, and the other side of the ADF 940 rotatably covers the platen glass 906.

Figure 2:
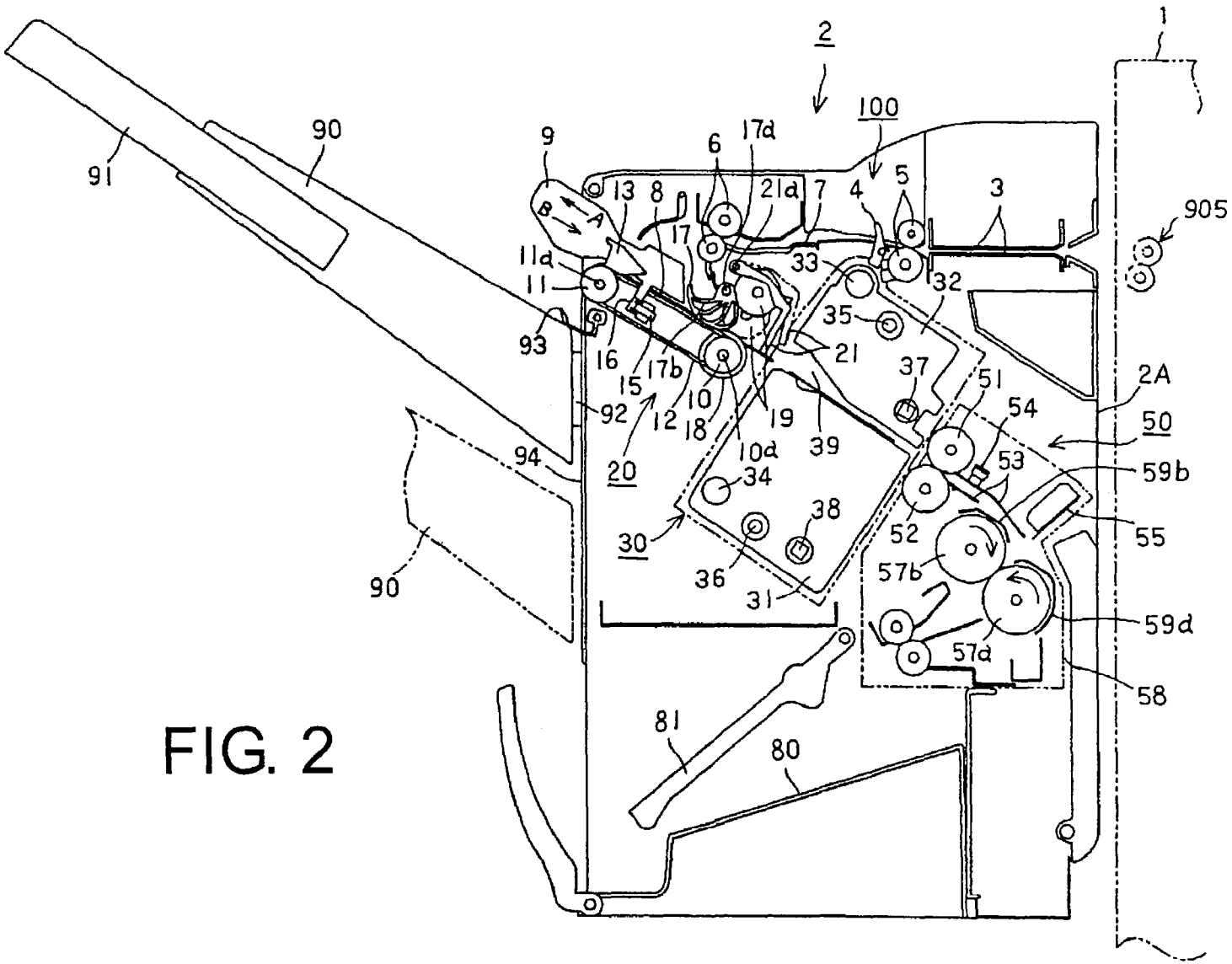
FIG. 2 is a side view of a sheet post-processing device.

As shown in FIG. 2, the sheet post-processing device 2 includes, in a device frame 2A as a casing of the sheet post-processing device 2, a conveyance unit 100 for conveying the sheet discharged from the digital copying apparatus main unit 1 in a substantially horizontal direction opposite to the discharge roller pair 905; an offset unit 20 arranged obliquely below the conveyance unit 100 for shifting an edge of the sheet; a stapler unit 30 arranged obliquely at downstream of the offset unit 20 for performing a stitching process on a sheet stack formed of a plurality of the sheets; a folding unit 50 arranged obliquely at downstream of the stapler unit 30 for performing a folding process on a folding position of the sheet stack as a predetermined position; a stack unit for collecting the sheets or booklet; and a controller for controlling these units in the sheet post-processing device 2.

The conveyance unit 100 includes a conveyance guide 3 for receiving the sheets successively discharged from the digital copying apparatus main unit 1 and guiding the sheets into the sheet post-processing device 2; a conveyance path guide 7 arranged at downstream of the conveyance guide 3 for guiding the sheets toward further downstream; a pair of conveyance rollers 5 arranged between the conveyance guide 3 and conveyance path guide 7 for nipping and conveying the sheets; a sheet detector sensor 4 arranged in the vicinity of a downstream position of the conveyance roller pair 5 for detecting the sheets brought into the conveyance path guide 7 and a jam of the sheets in the conveyance unit 100; and a pair of discharge rollers 6 arranged at the most downstream position in the conveyance path guide 7 for nipping and discharging the sheets.

As shown in FIG. 2, the offset unit 20 includes a process tray 8 for collecting the sheets discharged through the discharge roller pair 6. The process tray 8 is arranged obliquely with an angle of about 30 degrees relative to a placement surface of the digital copying apparatus main unit 1 downwardly in the sheet conveyance direction to assist the offset unit 20 to convey the sheet. Alignment plates 9 are disposed on the process tray 8 for guiding both sides of the sheets for alignment in a width direction.

Figure 3:
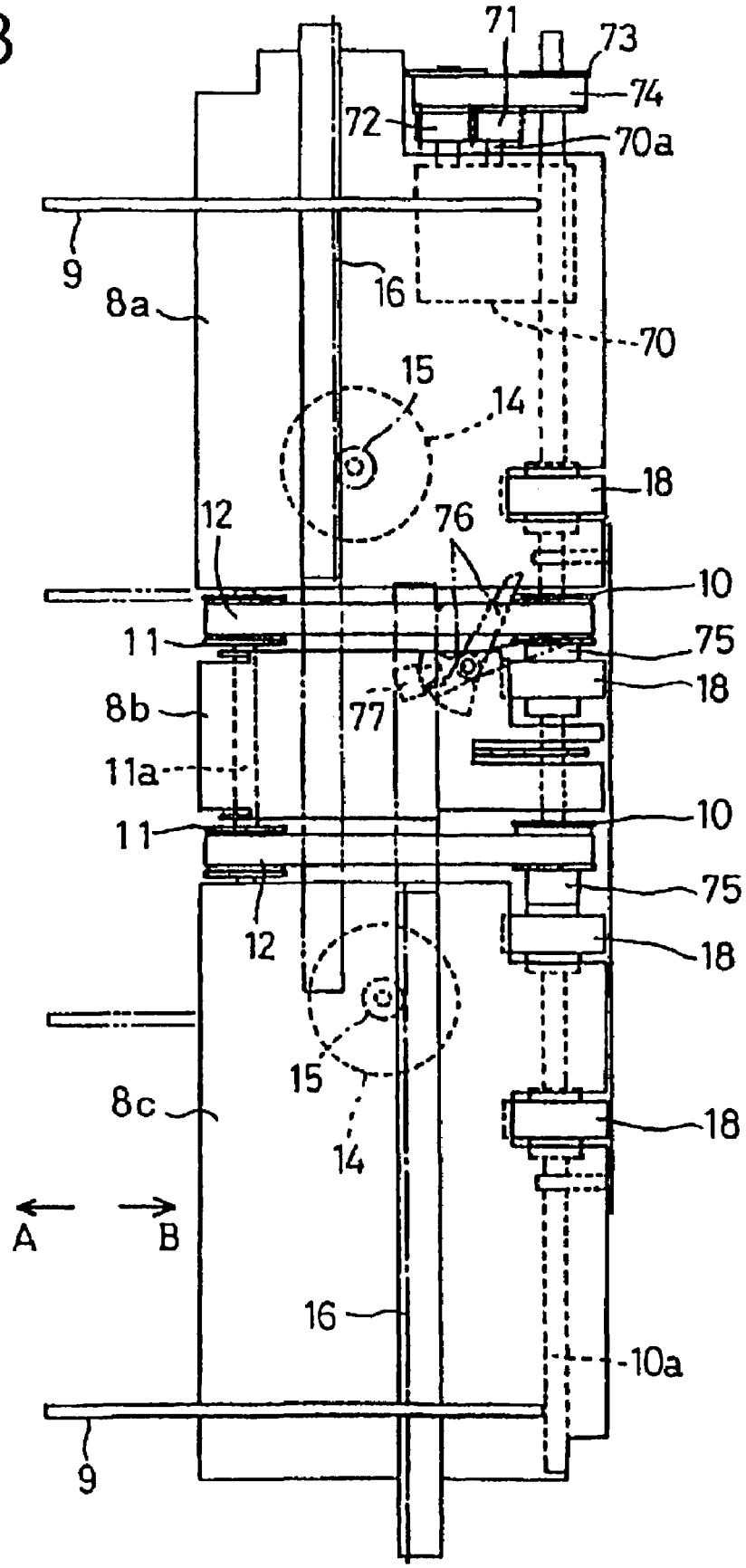
FIG. 3 is a plan view of a process tray of the sheet post-processing device.

As shown in FIG. 3, the process tray 8 has a rectangular shape elongated in a width direction substantially perpendicular to the sheet conveyance direction (i.e., a direction represented by an arrow B). The process tray 8 is divided into three portions, namely, a left tray 8*c* supporting a left portion (top portion in FIG. 3) of the sheet advancing in the sheet conveyance direction, a center tray 8*b* supporting a center portion of the sheet, and a right tray 8*a* supporting a right portion (bottom portion in FIG. 3).

Alignment motors 14 rotatable in forward and reverse directions are arranged on the left tray 8*c* and right tray 8*a* at lower portions thereof near the center tray 8*b*, respectively. Each of the alignment motors 14 has a pinion 15 fixed to a motor shaft thereof. The pinion 15 engages a rack 16 having a length substantially the same as that of the left tray 8*c* and right tray 8*a* in the width direction.

A fixing member having an elongated rectangular shape extends from a lower portion of each of the alignment plates 9. An end of the fixing member is fixed to the rack 16 through a slit extending in the width direction of the left tray 8*c* and right tray 8*a* (see also FIG. 2). The alignment plates 9 are thus movable in the width direction of the right tray 8*a* and left tray 8*c* as the alignment motors 14 rotate.

A stepping motor 70 rotatable in forward and reverse directions is arranged below the right tray 8*a* at one side thereof (a side of the stapler unit 30). The stepping motor 70 has a gear 71 fixed to a motor shaft 70*a* thereof. The gear 71 engages a gear portion of a gear pulley 72 pivotally supported on a fixed arm extending from the stepping motor 70. A timing belt 74 is placed between a pulley portion of the gear pulley 72 and a pulley 73. The pulley 73 is fixed to a first pulley shaft 10*a* rotatably supported below the process tray 8 at one side thereof and having a length substantially the same as the width of the process tray 8. A second pulley shaft 11*a* having a length shorter than that of the first pulley shaft 10*a* is rotatably supported below the center tray 8*b* at a position opposite to the first pulley shaft 10*a* (the other side of the center tray 8*b*).

The first pulley shaft 10*a* has four conveyance lower rollers 18 rigidly attached thereto, i.e., two rollers on a right side and the two other rollers on a left side of the sheet advancing in the sheet conveyance direction (i.e., an upper side and a lower side in FIG. 3). The conveyance lower rollers 18 have a hollow shape like a tire. A circumference of each conveyance lower roller 18 is exposed above a top surface of the process tray 8 through a cutout formed in one side of the process tray 8 (see also FIG. 4).

The first pulley shaft 10*a* is attached to first pulleys 10 having a diameter smaller than the conveyance lower rollers 18 through one-way clutches 75 transferring only counterclockwise rotation to the first pulleys 10. Second pulleys 11 are attached to both ends of the second pulley shaft 11*a* and have a diameter the same as that of the first pulley 10. The first pulley 10 and second pulley 11 are arranged between the center tray 8*b* and the right tray 8*a*, and between the center tray 8*b* and the left tray 8*c*.

Two endless conveyance belts 12 are placed between the first pulleys 10 and second pulleys 11. Accordingly, the rotation of the stepping motor 70 transferred to the first pulley shaft 10*a* through the on-way clutch 75 is transferred to the second pulley 11 only when the first pulleys 10 rotate counterclockwise, in other words, only when the conveyance belts 12 move in the arrow direction A in FIG. 3. When the first pulley shaft 10*a* rotates clockwise (when the conveyance belts 12 conveys in the arrow direction B in FIG. 3), the rotation is not transferred to the second pulleys 11.

As shown in FIG. 2, a paddle 17 is disposed below the conveyance path guide 7 and above the process tray 8. The paddle 17 rotates around an axis 17*a* for urging the sheet in the sheet conveyance direction. The paddle 17 is formed of an elastic material such as rubber having a certain elasticity, and includes integrally formed fins 17*b* radially extending from the axis 17*a* as the center thereof. As the sheets are discharged or collected into the process tray 8, the paddle 17 deforms elastically, thereby providing an appropriate urging force to the sheets in the sheet conveyance direction.

Figure 4:
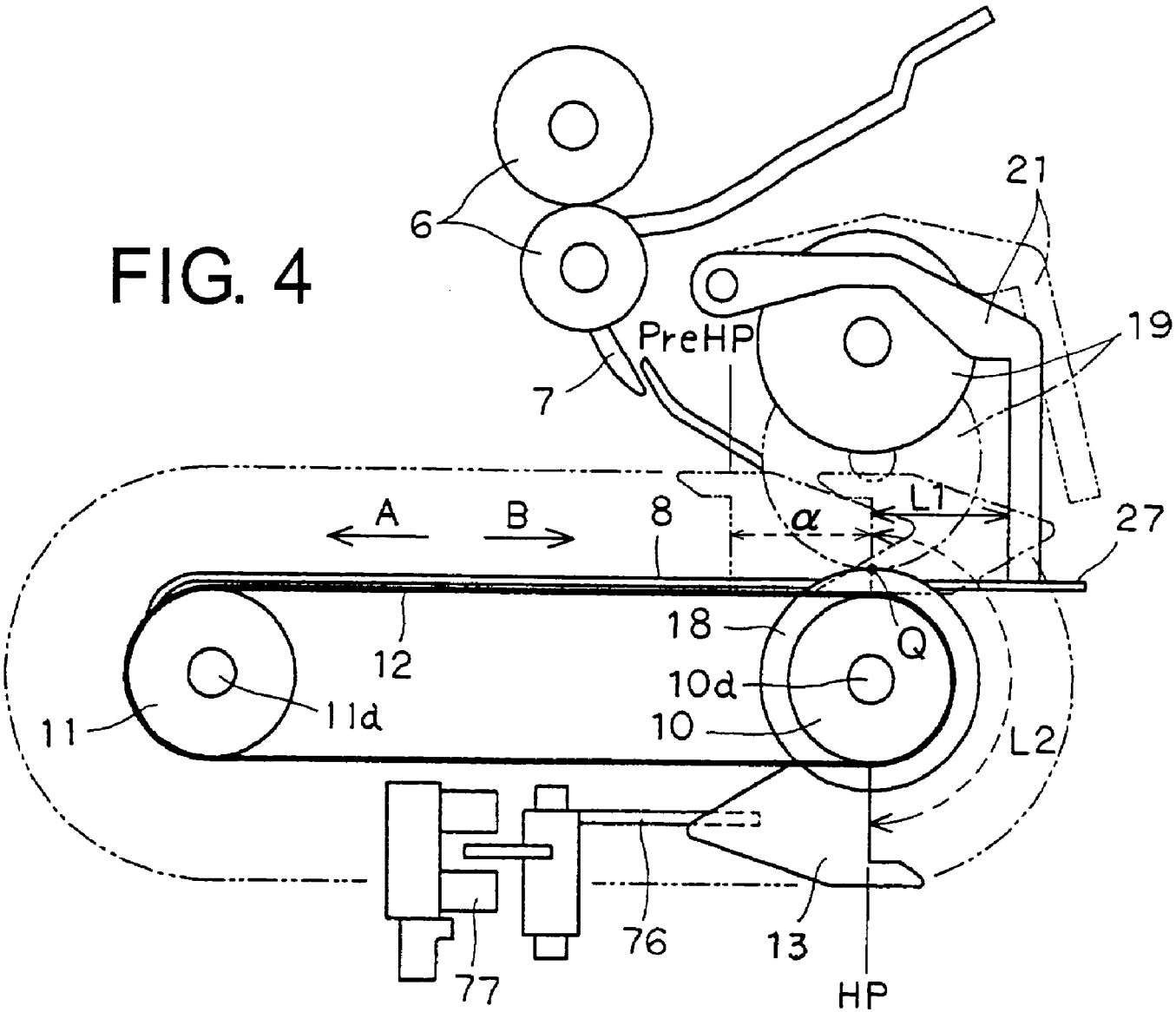
FIG. 4 is a side view of a conveyance belt of the process tray of the sheet post-processing device.

As shown in FIG. 4, a pushing claw 13 is attached to the conveyance belt 12 for abutting an edge of the sheet stack composed of a plurality of the sheets on the process tray 8 and pushing the sheet stack in the arrow direction A. The pushing claw 13 has a home position (also referred to as HP position), where an edge of the pushing claw 13 is located right below the first pulley shaft 10*a*. A detector arm 76 engaging the pushing claw 13 and an arm detector sensor 77 formed of an emitter-receptor integrated type are arranged below the conveyance belt 12 for detecting the HP position of the pushing claw 13 (also see FIG. 3).

A conveyance upper roller 19 is arranged above each of the conveyance lower rollers 18. The conveyance upper roller 19 moves between a contact position (a first position) where the conveyance upper roller 19 contacts the conveyance lower roller 18 at a contact point (nip) Q as represented by a phantom line in FIG. 4 and a spaced position (a second position) where the conveyance upper roller 19 is away from the conveyance lower roller 18. The conveyance upper roller 19 moves between the contact position and the spaced position through a cam (not shown), etc., and the conveyance upper roller 19 rotates with the stepping motor 70 (see FIG. 12) through a gear (not shown).

A first stack guide 27 having a plate shape is arranged on a tilted plane the same as that of the process tray 8 at downstream of the process tray 8 for supporting (hold) the sheet stack in cooperation with the process tray 8. A stopper 21 is arranged above the first stack guide 27 for restraining and aligning edges of the sheets. The sheets are urged downwardly in the sheet conveyance direction by their own weight on the tilted process tray 8 and first stack guide 27, and are further urged by the rotation of the paddle 17.

Figure 5:
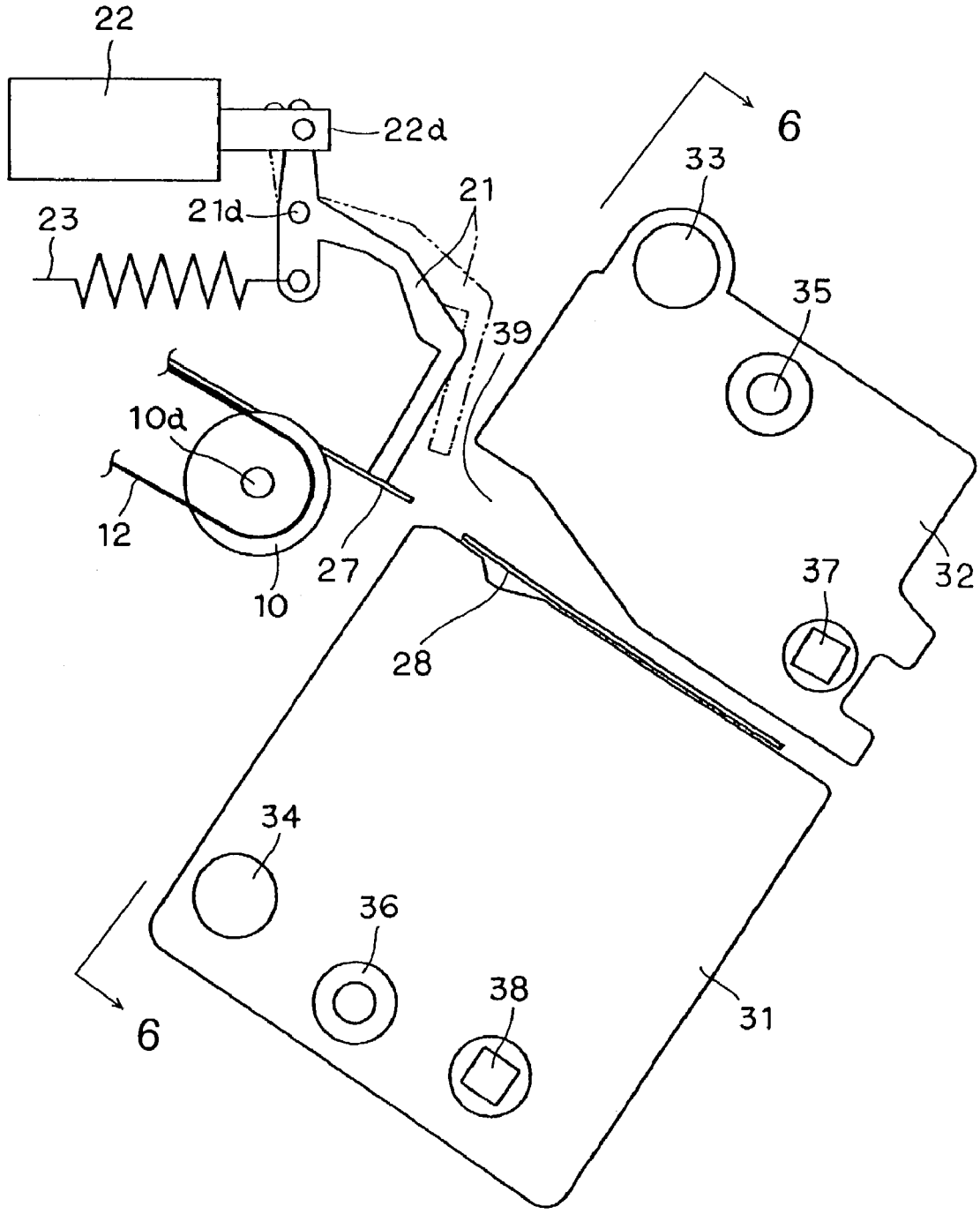
FIG. 5 is a side view of a stopper of the sheet post-processing device.

As shown in FIG. 5, the stopper 21 has a J-shaped cross section with an arm and a leg. One end of the arm is connected to a plunger 22*a* of a solenoid 22, and the other end of the arm is pulled by a spring 23 with a predetermined tension. Accordingly, in response to an on/off operation of the solenoid 22, the stopper 21 pivotally moves around a support shaft 21*a* located at the approximate center of the arm thereof between a restraining position represented by a solid line where a bottom surface of the leg (an end of the leg) abuts against a top surface of the first stack guide 27 and a retraction position represented by a phantom line where the stopper 21 is retracted from the top surface of the first stack guide 27. The stopper 21 normally stays at the retraction position (with the solenoid 22 remaining in the off state) represented by the solid line.

The pushing claw 13 can move in a direction represented by an arrow A in FIG. 4 in a normal state (with the conveyance upper roller 19 at the spaced position and the stopper 21 at the retraction position). L1 represents a distance between the end face of the pushing claw 13 and the stopper 21 when the end face of the pushing claw 13 is positioned at the contact point Q between the conveyance lower roller 18 and the conveyance upper roller 19. L2 represents a distance from the end face of the pushing claw 13 at the HP position to the contact point Q. In this case, it is arranged that L1 is smaller than L2.

As shown in FIG. 4, the lower end portion of the conveyance path guide 7 extending below the discharge roller pair 6 engages a fixed guide pressing the sheet discharged into the process tray 8 to prevent the edge of the sheet from being lifted above the conveyance upper roller 19.

As shown in FIGS. 2 and 5, the stapler unit 30 is arranged at downstream of the offset unit 20. The stapler unit 30 includes a head assembly 31 and anvil assembly 32. The head assembly 31 has a staple cartridge disposed below a conveyance path 39 for conveying the stack of the sheets to drive a staple. The anvil assembly 32 is disposed above the head assembly 39 for receiving tips of the staple driven from the head assembly 31 to fold the staple. A second stack guide 28 is arranged in the conveyance path 39 above the head assembly 31 at a position away from an insertion head of the head assembly 31 that drives the staple, and has a tilted plane the same as that of the first stack guide 27. The stapler unit 30 is formed in a unit as represented by a phantom line in FIG. 2, and can be drawn toward front in FIGS. 2 and 5 for replenishing staples.

Figure 6:
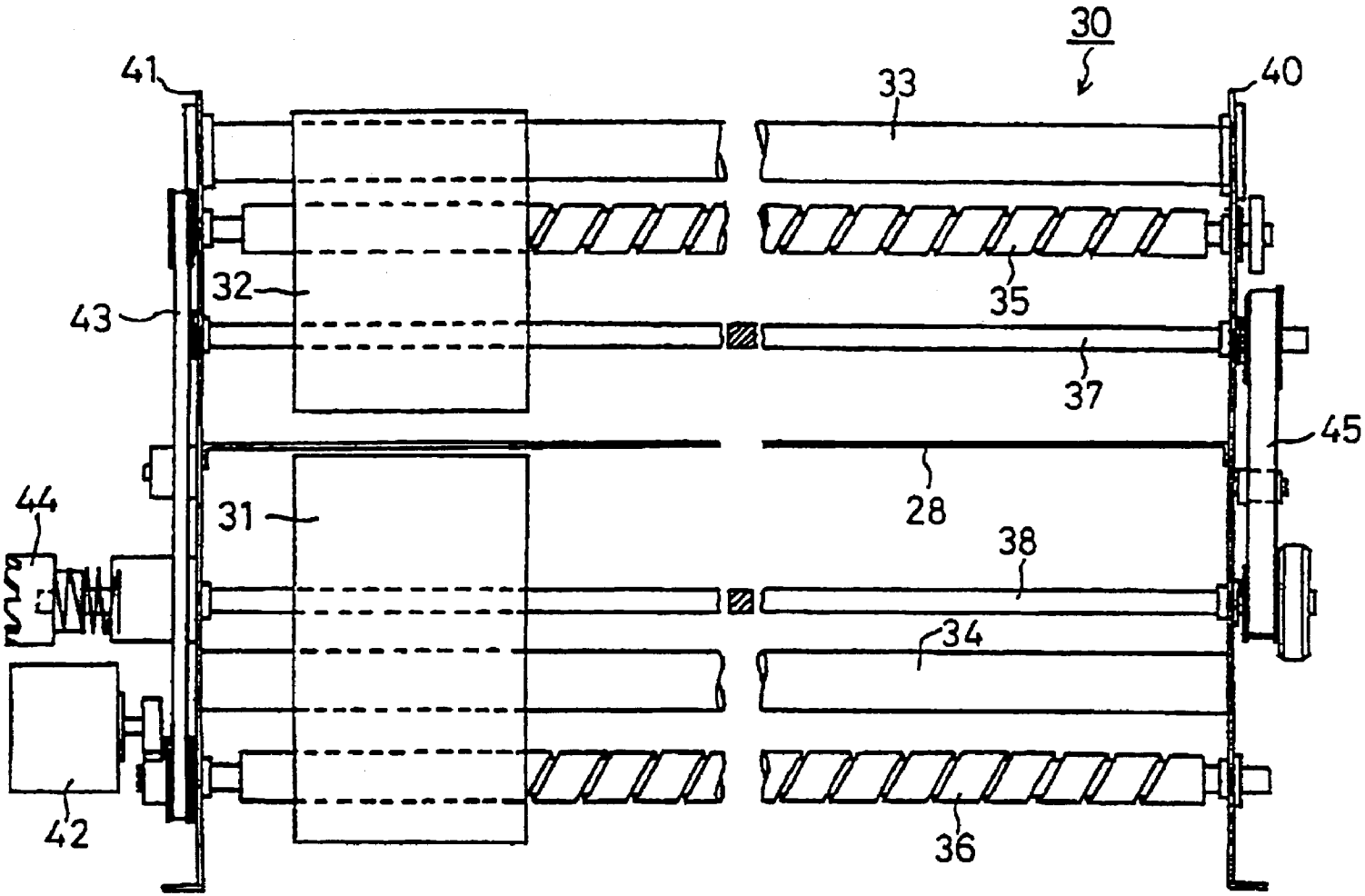
FIG. 6 is a front view of a stapler unit of the sheet post-processing device viewed from line 6—6 in FIG. 5.

As shown in FIG. 6, the stapler unit 30 includes guide rods 33, 34 between left and right unit frames 40, 41 for support and guiding the head assembly 31 and anvil assembly 32 in a direction perpendicular to the sheet conveyance direction; guide screw shafts 35, 36 having helical screws thereon for sliding the head assembly 31 and anvil assembly 32 in the direction perpendicular to the sheet conveyance direction; and an anvil driving shaft 37 and head driving shaft 38 having a rectangular cross section for allowing the head assembly 31 and anvil assembly 32 to perform a staple driving operation and staple folding operation, respectively.

The head assembly 31 and anvil assembly 32 engage the guide screw shafts 36, 35. When the guide screw shafts 36, 35 rotate, the head assembly 31 and anvil assembly 32 move leftward or rightward in FIG. 6. A stapler slide motor 42 is arranged at the outside of the unit frame 41 for rotating the guide screw shaft 36 in a forward or reverse direction through gears. At the same time, the rotation of the stapler slide motor 42 is transferred to the anvil assembly 32 through a timing belt 43 placed around pulleys fixed to the guide screw shafts 36, 35 at the outside of the unit frame 41.

A stapling/folding stepping motor 170 (see FIG. 12) transfers the rotation thereof to the head driving shaft 38 through a coupling device 44 arranged at the outside of the unit frame 41. The rotation of the stapling/folding motor 170 is also transferred to the anvil assembly 32 through a timing belt 45 placed around pulleys fixed to the head driving shaft 38 and anvil driving shaft 37 at the outside of the unit frame 40. In this arrangement, the head assembly 31 and anvil assembly 32 move in synchronization with each other in the direction perpendicular to the sheet conveyance direction while maintaining a vertical alignment therebetween. The stapler slide motor 42 is controlled to move the head assembly 31 and anvil assembly 32 to drive the staple into the sheets at an appropriate position in accordance with the width of the sheets.

As shown in FIG. 2, the folding unit 50 is formed in a unit represented by a phantom line and arranged at downstream of the stapler unit 30. Similar to the stapler unit 30, the folding unit 50 is detachable from the sheet post-processing device 2.

A general construction of the folding unit 50 is first described. A stack conveyance upper roller 51 and stack conveyance lower roller 52 are arranged at an entrance of the folding unit 50 for nipping and conveying the sheet stack in a downstream direction. A stack conveyance guide 53 is arranged at downstream of the stack conveyance upper roller 51 and stack conveyance lower roller 52 for guiding the sheet stack fed from the roller pair further in a downstream direction. An edge detector sensor 54 formed of an emitter-receptor integrated type sensor is arranged in the sheet stack conveyance path of the stack conveyance guide 53 for detecting a forward edge of the sheet stack. According to a signal of detecting the forward edge of the sheet stack, a controller (described later) allows the stack conveyance upper roller 51 to press against the stack conveyance lower roller 52, and controls to set a folding position of the sheet stack in the sheet conveyance direction.

Figure 9A:
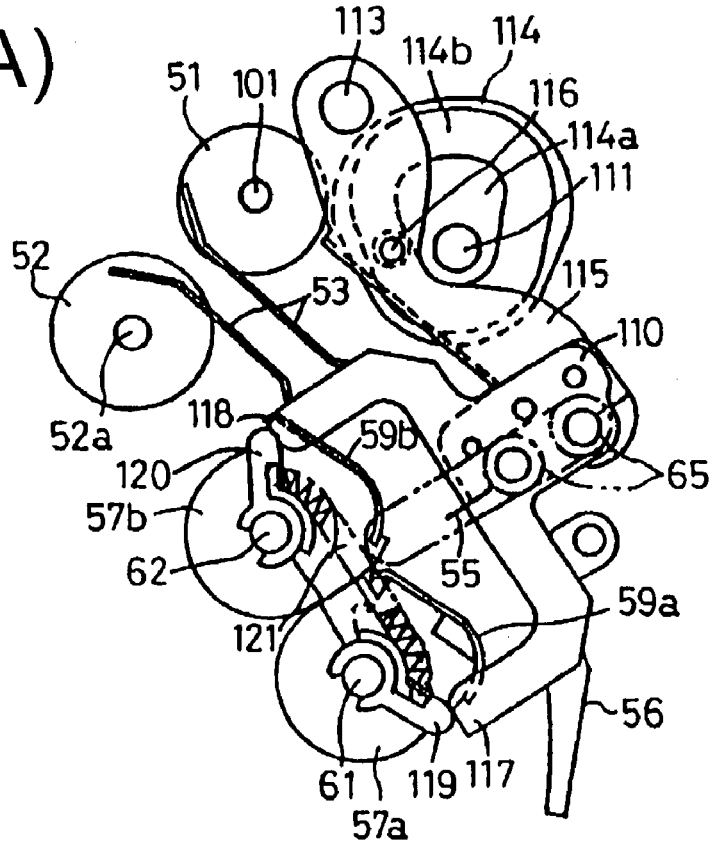
FIG. 9(A) is a side view of a folding mechanism of the folding unit.
Figure 9B:
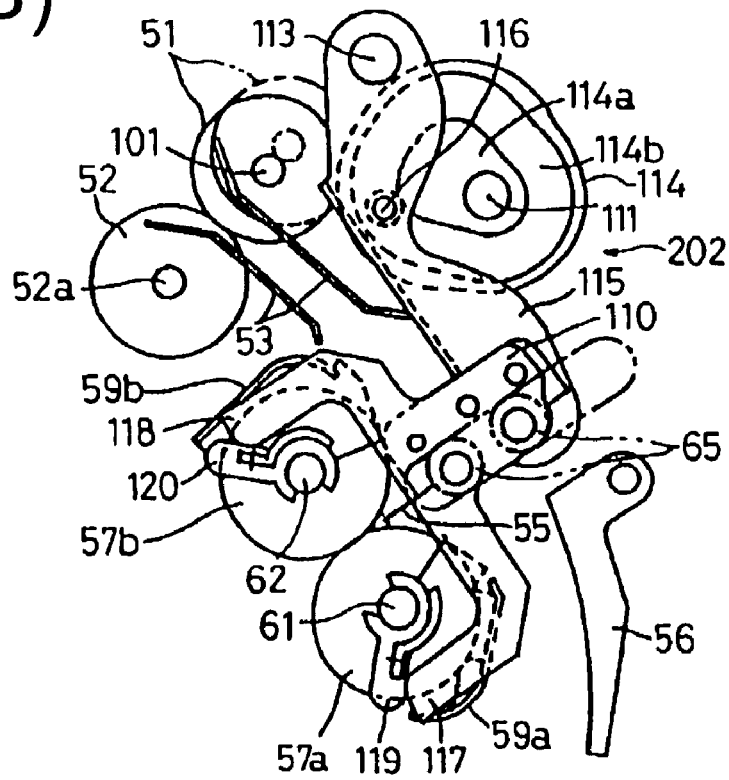
FIG. 9(B) is a side view of the folding mechanism during the folding operation.

The stack conveyance upper roller 51 moves between a position represented by a solid line where the stack conveyance upper roller 51 is pressed against the stack conveyance lower roller 52 and a spaced position where the stack conveyance upper roller 51 is away from the stack conveyance lower roller 52 (as represented by a projected line in FIG. 9(B)). The stack conveyance upper roller 51 remains at the spaced position away from the stack conveyance lower roller 52 until the edge detector sensor 54 detects the forward edge of the sheet stack. The rollers 51 and 52 are pressed against with each other when the edge detector sensor 54 detects the forward edge of the sheet stack.

A pair of rollers 57*a* and 57*b* is arranged below the stack conveyance guide 53, and is respectively driven and pressed against each other in a direction perpendicular to the sheet stack conveyance direction for folding the sheet stack. Each of the rollers 57*a* and 57*b* has a diameter so that each roller rotates at least one revolution during the folding of the sheet stack.

A pushing plate 55 is arranged at downstream of the stack conveyance guide 53 in a direction perpendicular to the sheet stack conveyance direction. An edge of the pushing plate 55 moves close to the contact position of the folding rollers 57*a,* 57*b* to push the sheet stack into the contact position between the folding rollers 57*a,* 57*b*. The pushing plate 55 is made of stainless steel, and has a thickness of 0.25 mm at the end thereof.

Backup guides 59*a* and 59*b* having semicircular shapes in cross section are arranged above the folding rollers 57*a* and 57*b* for assisting the stack conveyance guide 53 to guide the sheet stack. As will be described later, the backup guides 59*a* and 59*b* move when the pushing plate 55 moves up and down in a direction perpendicular to the sheet stack conveyance direction. When the edge of the pushing plate 55 moves close to the nip between the folding rollers 57*a* and 75*b,* the backup guides 59*a* and 59*b* move and open circumferences thereof relative to the sheet stack.

Figure 7A:
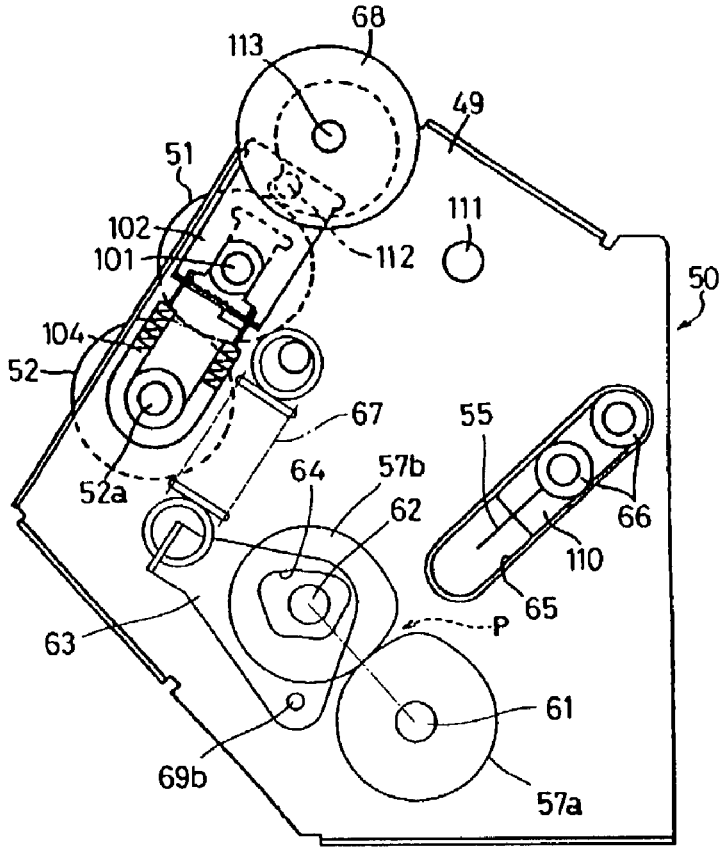
Figure 7B:
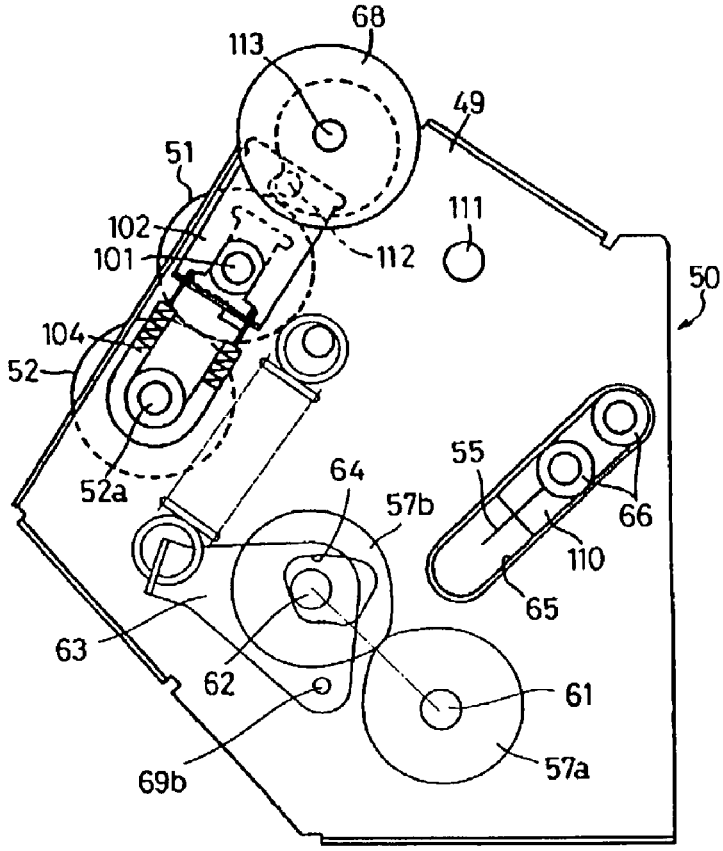

The folding unit 50 is described below in detail. As shown in FIGS. 7(A) and 7(B), the folding rollers 57*a* and 57*b* are fixed to folding roller driving shafts 61 and 62 pivotally and rotatably supported on a unit frame 49. A roller holder 63 having a substantially triangular shape is attached to the folding roller driving shaft 62 so that the folding roller driving shaft 62 passes through the center of the folding roller holder 63. The folding roller holder 63 has one end rotatably supported on a fixed shaft 69*b* fixed to the unit frame 49, and an end furthermost from the one end pulled by a pulling spring 67 fixed to the unit frame 49 with a pulling force of about 49 N (5 kgf).

The unit frame 49 has a guide hole 64 for allowing the folding roller driving shaft 62 to move therein when the folding roller holder 63 rotates. Therefore, when the folding rollers 57*a* and 57*b* fold the sheet stack, the pulling spring 67 applies a constant pressure on the sheet stack to assure the folding operation. At the same time, a distance between the folding roller driving shafts 61, 62 of the folding rollers 57*a* and 57*b* is variable.

Figure 8:
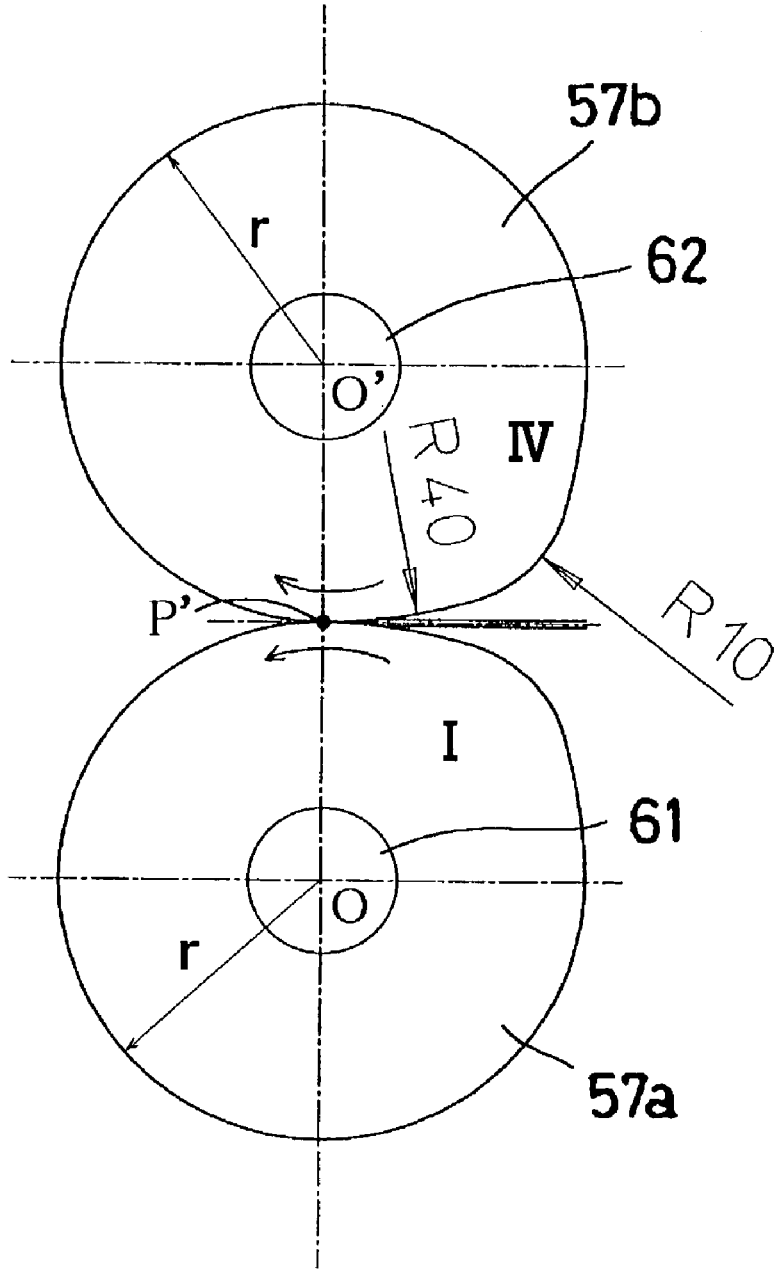
FIG. 8 is a view schematically illustrating curve radii of the folding rollers.

A shown in FIG. 8, the folding rollers 57*a* and 57*b* have curved portions having a constant radius r (for example, 20 mm) from rotational centers O, O' except a portion corresponding to the first quadrant I of the folding roller 57*a* and the fourth quadrant IV of the folding roller 57*b*. Each of the first and fourth quadrants on the folding rollers 57*a* and 57*b* has two curved portion having a curve radius of 40 mm, and three curved portions having curve a curve radius of 10 mm therebetween. A transitional area between the curved portions is formed in a smooth curve.

As shown in FIGS. 7(A) and 7(B), the pushing plate 55 projects from a roll 66 movably retained in a support holder 110. The unit frame 49 has a pushing plate guide slot 65 for guiding the roll 66 in the support holder 110. The pushing plate 55 moves toward the nip P of the folding rollers 57*a* and 57*b* while being guided by the pushing plate guide slot 65.

An upper roller shaft 101 of the stack conveyance upper roller 51 and lower roller shaft 52*a* of the stack conveyance lower roller 52 are supported on the unit frame 49 for conveying the sheet stack to the folding unit 50. The stack conveyance upper roller 51 and stack conveyance lower roller 52 need to be spaced each other until the sheet stack is brought into the folding unit 50. For this reason, it is arranged that the stack conveyance upper roller 51 is situated at a position away from the stack conveyance lower roller 52 with the following mechanism.

Specifically, the upper roller shaft 101 is supported on a bearing holder 102. A cam follower 112 projects from a top end portion of the bearing holder 102. The cam follower 112 engages an upper roller movement cam 68 rotatably supported on the unit frame 49. A pulling spring 104 having a pulling force of approximately 2.9 N (about 300 gf) extends between the lower ends of the bearing holder 102 and the lower roller shaft 52*a* to press the stack conveyance upper roller 51 against the stack conveyance lower roller 52. The bearing holder 102 is lifted against the pulling spring 104 when the upper roller movement cam 68 rotates. Accordingly, the stack conveyance upper roller 51 moves between the position spaced apart from the stack conveyance lower roller 52 and the contact position.

As shown in FIGS. 9(A) and 9(B), the folding unit 50 includes a cam plate 114 having a cam 114*a* for moving the pushing plate 55. The cam plate 114 is fixed to a cam driving shaft 111 pivotally supported on the unit frame 49. A cam timing of the cam plate 114 is set so that the pushing plate 55 moves about twice as fast as the folding rollers 57*a* and 57*b,* and so that the pushing plate 55 does not contact both edges of the sheet stack even if the pushing plate 55 pushes twice or more.

It is arranged that the movement speed of the pushing plate 55 is predetermined times fast as the conveyance speed of the folding rollers 57*a* and 57*b*. Therefore, a period of time for the stitched position of the sheet stack conveyed by the folding rollers 57*a* and 57*b* to reach the nip P becomes substantially equal to a period of time for the pushing plate 55 to reach the nip of the folding rollers 57*a* and 57*b* after the pushing plate 55 contacts the stitching position of the sheet stack. Thus, the folding rollers 57*a* and 57*b* and pushing plate 55 move in synchronization.

It is also arranged that the timing of the movement of the pushing plate 55 after a double pushing is mechanically set so that the pushing plate 55 does not contact both edges of the folded sheet stack having a predetermined size. The movement timing of the pushing plate 55 is set in this way, and the folding timing of the folding rollers 57*a* and 57*b* is also set with the roller diameter thereof as a predetermined value. Specifically, the folding operation is performed at the two timings when the sheet stack is folded. Accordingly, regardless of the size of the sheet, it is possible to prevent the pushing plate 55 from touching both edges of the sheet.

An actuator arm 115 having a bow shape in cross section is pivotally supported at one end thereof on a shaft 113 of the upper roller movement cam 68. The support holder 110 is fixed to the other end of the actuator arm 115 as a pivoting end. The cam plate 114 has a cam groove 114*b*. A cam follower 116 projecting from an approximate center of the actuator arm 115 is inserted in the cam groove 114*b*. When the cam plate 114 rotates, the cam 114*a* presses the cam follower 116 to lift the actuator arm 115. The pushing plate 55 fixed to the actuator arm 115 is thus movable between a position for pushing the sheet stack and a standby position.

Levers 119 and 120 are rotatably supported on the folding roller driving shafts 61 and 62 of the folding rollers 57*a* and 57*b,* respectively. Backup guides 59*a* and 59*b* are attached to the levers 119 and 120 for covering the circumferences of the folding rollers 57*a* and 57*b*, and are rotatably supported on the folding roller driving shafts 61 and 62 with respect to the circumferences of the folding rollers 57*a* and 57*b*. The backup guides 59*a* and 59*b* are pulled to each other by a spring 121. Ends of the levers 119 and 120 engage and are supported on end portions 117 and 118 branched from the support holder 110.

A guide 56 is disposed below the support holder 110 for shifting the stack conveyance direction of the sheet stack nipped between and conveyed by the stack conveyance upper roller 51 and stack conveyance lower roller 52 to a downward direction. The guide 56 guides the sheet stack so that the forward edge of the sheet stack is suspended downward in a sheet stack passage 58 (see FIG. 2) formed between a device frame 2A and the folding unit 50.

As shown in FIG. 9(A), when the stack conveyance upper roller 51 is away from the stack conveyance lower roller 52, the backup guides 59*a* and 59*b* are positioned to cover the circumferences of the folding rollers 57*a* and 57*b* at a side of the conveyance passage. Thus, the backup guides 59*a* and 59*b* function as an extension from the lower stack conveyance guide 53, thereby assisting the stack conveyance guide 53 to convey the sheet.

As shown in FIG. 9(B), when the operation of folding the sheet stack is performed, the support holder 110 is lowered toward the nip P between the folding rollers 57*a* and 57*b*. The levers 119 and 120 are lowered by the end portions 117 and 118, and the backup guides 59*a* and 59*b* rotate around the folding roller driving shafts 61 and 62 against the spring 121, thereby allowing the circumferences of the folding rollers 57*a* and 57*b* to contact the sheet stack.

The drive transfer system of the folding unit 50 is divided into a stack conveyance roller driving subsystem for driving (rotating and moving away) the stack conveyance upper roller 51 and stack conveyance lower roller 52, and a folding roller/pushing plate driving subsystem for rotating the folding rollers 57*a* and 57*b* while moving the pushing plate 55. These subsystems are arranged at a deep side of the unit frame 49 as shown in FIGS. 7(A) and 7(B).

Figure 10:
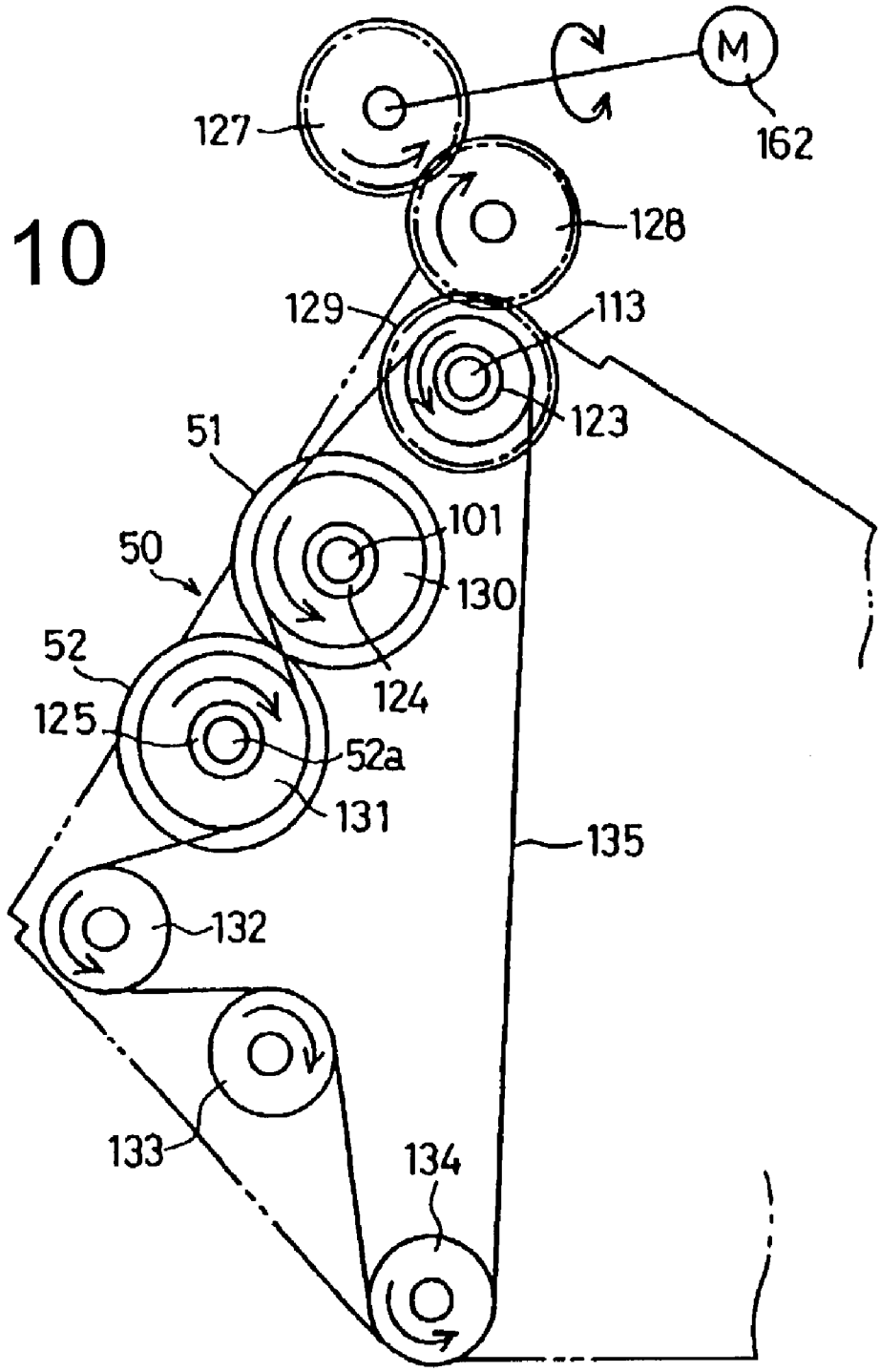
FIG. 10 is a side view of a driving system of transfer rollers of the folding unit.

As shown in FIG. 10, a conveyance motor 162 formed of a stepping motor capable of rotating in forward and reverse directions drives the stack conveyance roller driving subsystem. The rotation of the conveyance motor 162 is transferred to a gear pulley 129 through gears 127 and 128. A one-way clutch 123 is interposed between the gear pulley 129 and the shaft 113 driving the upper roller movement cam 68. Accordingly, with the one-way clutch 123, the upper roller movement cam 68 rotates to move the stack conveyance upper roller 51 vertically only when the gears 127 and 128 rotate in directions opposite to the arrow directions in FIG. 10.

The rotation of the gear pulley 129 is transferred to the upper roller shaft 101 and lower roller shaft 52*a* through a timing belt 135 placed around pulleys 130 and 131. A one-way clutch 124 is interposed between the pulley 130 and the upper roller shaft 101, and a one-way clutch 125 is interposed between the pulley 131 and the lower roller shaft 52*a*. Accordingly, the upper roller shaft 101 and lower roller shaft 52*a* rotate only when the pulleys 130 and 131 rotate in the arrow directions in FIG. 10. The timing belt 135 is also placed around pulleys 132, 133, and 134.

When the gears 127 and 128 rotate in the arrow directions in FIG. 10, the stack conveyance upper roller 51 and stack conveyance lower roller 52 rotate in directions to convey the sheet stack into the folding unit 50. When the gears 127 and 128 rotate in the directions opposite to the arrow directions in FIG. 10, the upper roller movement cam 68 rotates, thereby spacing the stack conveyance upper roller 51 away from the stack conveyance lower roller 52. A controller 149 (described later) controls these operations when sensors detect flag pegs (not shown) fixed to a shaft 132 of a pulley 133.

Figure 11:
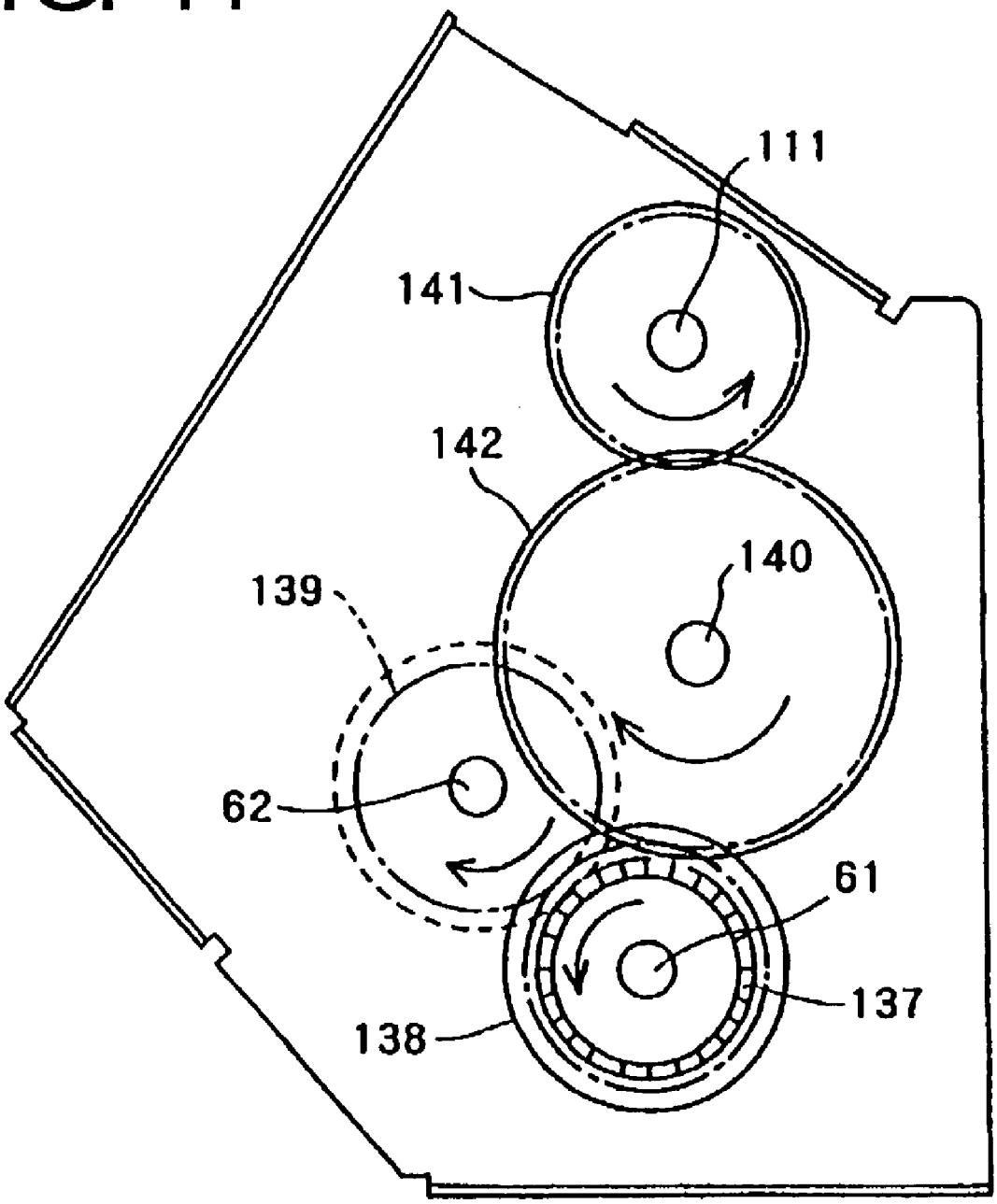
FIG. 11 is a side view of a driving system of the folding rollers and a pushing plate of the folding unit.

As shown in FIG. 11, the stapling/folding motor 170 drives the folding roller/pushing plate driving subsystem (see FIG. 12) through a coupling device 137 attached to the folding roller driving shaft 61. The stapling/folding motor 170 drives the coupling device 44 of the stapler unit 30 shown in FIG. 6 with the forward rotation, or drives the coupling device 137 with the reverse rotation through a driving and transfer system (not shown).

The rotation of the coupling device 137 is transferred to a gear 139 rigidly fixed to the folding roller driving shaft 62 through the gear 138 rigidly fixed to the folding roller driving shaft 61. Furthermore, the rotation of the gear 138 is transferred to the cam driving shaft 111 of the cam plate 114 through a gear 142 rotatable around a shaft 140 and a gear 141 engaging the gear 142. The cam plate 114 activates the actuator arm 115 to move the pushing plate 55. The controller (described later) determines a position of the cam plate 114 when a flag peg (not shown) attached to the cam driving shaft 111 is detected by a sensor.

As shown in FIG. 2, a folded sheet stack discharge stacker 80 is arranged at downstream of the folding unit 50 at a bottom portion of the sheet post-processing device 2. The folded sheet stack discharge stacker 80 has a tilted plane opposite to those of the offset unit 20, stapler unit 30, and stapler unit 30, and stocks the sheet stack folded by the folding unit 50. A folded sheet pressure member 81 having one end pivotally supported is arranged above the folded sheet stack discharge stacker 80. The folded sheet pressure member 81 presses the discharged sheet stack using an urging force of a spring or the like in cooperation with the force of gravity of the sheet stack working along the tilted plane of the folded sheet stack discharge stacker 80.

A lifting tray 90 is arranged on a sidewall of the device frame 2A opposite to the digital copying apparatus main unit 1. The lifting tray 90 moves in a vertical direction with respect to the device frame 2A. A lifting tray support 92 supports the lifting tray 90. A lifting tray motor 155 formed of a stepping motor capable of rotating in a forward and reverse directions (see FIG. 12) moves the lifting tray support 92 vertically through a belt (not shown). The lifting tray 90 is raised and lowered between an upper limit position represented by a solid line and a lower limit position represented by a phantom line in FIG. 3.

The lifting tray 90 includes an auxiliary tray 91, and the auxiliary tray 91 is pulled out from the lifting tray 90 to place a large-size sheet thereon. A sheet surface sensor 93 is arranged below the second pulley 11 of the offset unit 20 for detecting a top surface of the sheets on the lifting tray 90. A rear edge guide 94 is arranged on the sidewall of the lifting tray 90 of the device frame 2A for guiding the rear edge of the sheet on the lifting tray 90 when the lifting tray 90 is raised or lowered.

When the folding unit 50 folds the sheet stack, the sheet stack is collected on the folded sheet stack discharge stacker 80. When the folding unit 50 does not fold the sheet stack, the sheet stack is collected on the lifting tray 90.

Figure 12:
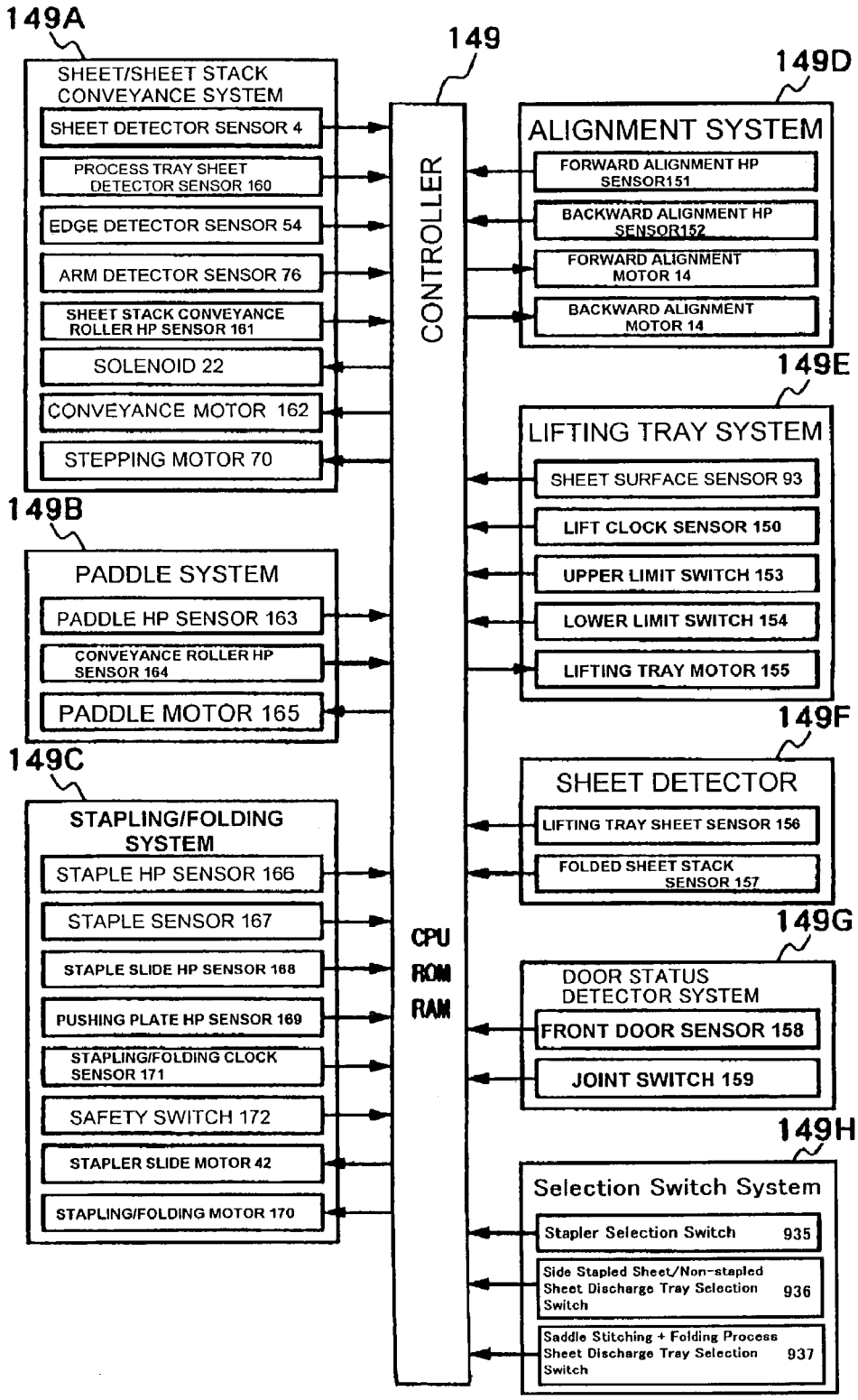
FIG. 12 is a block diagram illustrating a relationship between a controller, sensors and actuators of the sheet post-processing device.

As shown in FIG. 12, a controller 149 includes a central processing unit (CPU); a ROM for storing a program to be executed by the CPU and program data beforehand; a RAM for functioning as a work area for the CPU, and storing control data received from a controller 950 in the digital copying apparatus main unit 1 (see FIG. 1); and an interface.

Figure 13A:
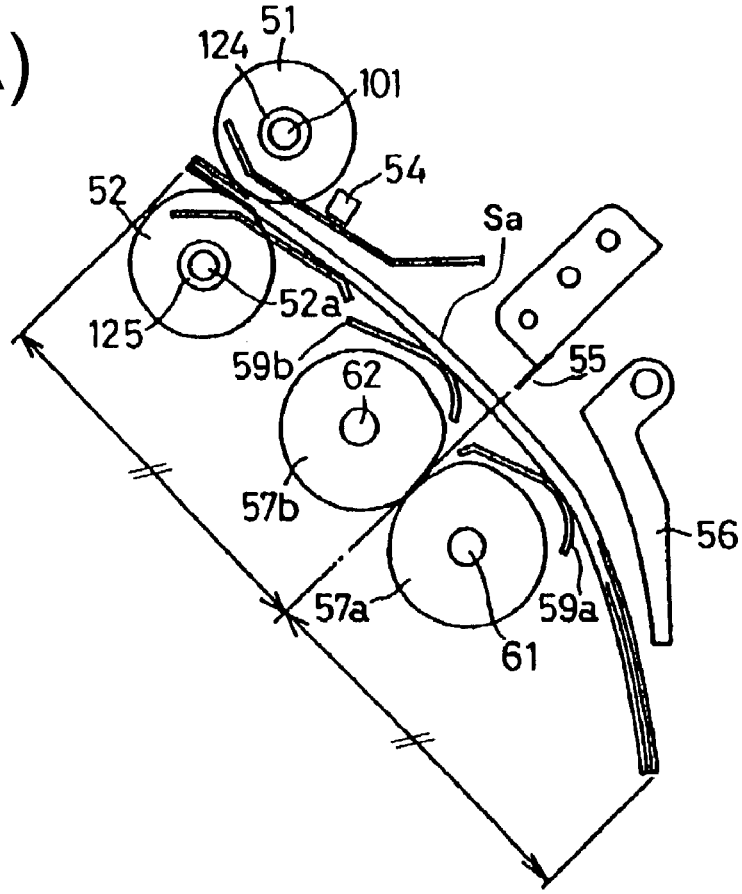
Figure 13B:
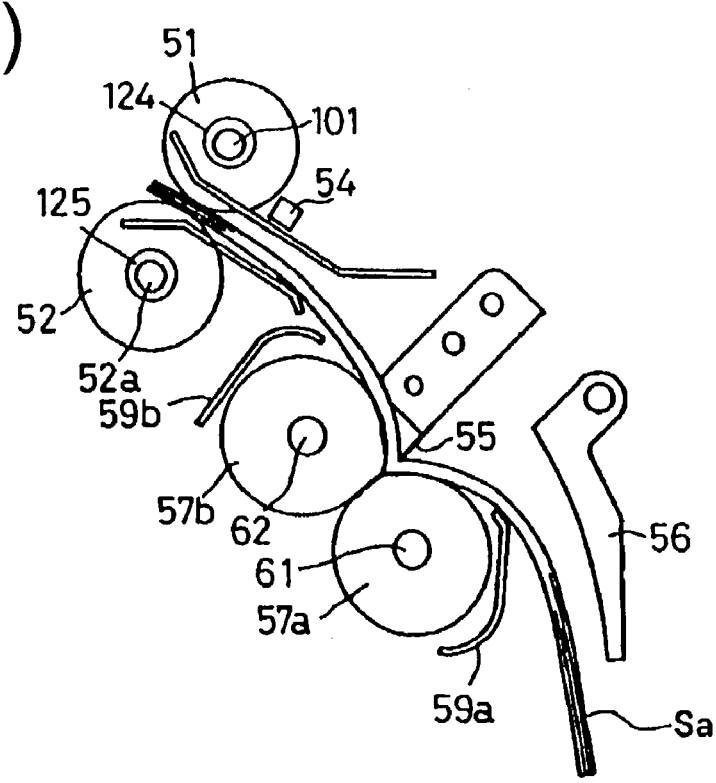

The controller 149 controls a sheet/sheet-stack conveyance system 149A, paddle system 149B, stapling/folding system 149C, alignment system 149D, lifting tray system 149E, sheet detector system 149F, door status detector system 149G, and selection switch system 149H. In FIGS. 13(A) and 13(B), there are two identical components. One of two identical components positioned forward in FIG. 12 is referred to as a "front" component, and the other component positioned rear is referred to as a "rear" component as referred to FIG. 2.

The sheet/sheet-stack conveyance system 149A, functioning as an input to the controller 149, works for the conveyance of the sheets and sheet stack. The sheet/sheet-stack conveyance system 149A includes a sheet detector sensor 4 for detecting the sheet on the conveyance guide 3; edge detector sensors 54 and 85 for detecting the edge of the sheet stack; an arm detector sensor 77 for detecting the HP position of the pushing claw 13; HP position detector sensors 305 and 315 for detecting the home positions of the sheet pressing levers 300, 310, respectively; and a sheet stack conveyance roller HP sensor 161 for detecting the home position of the stack conveyance upper roller 51 when the stack conveyance upper roller 51 is away from the stack conveyance lower roller 52.

Output components of the controller 149 include the solenoid 22 for positioning the stopper 21 at one of the restraining position and retraction position; solenoids 301 and 311 for pressing the sheets on the right tray 8*a* and left tray 8*c;* the conveyance motor 162 for driving respectively the conveyance roller pair 5, discharge roller pair 6, stack conveyance upper roller 51, and stack conveyance lower roller 52 while rotating the upper roller movement cam 68 to move the stack conveyance upper roller 51; the stepping motor 70 for moving the conveyance lower roller 18, conveyance upper roller 19, and conveyance belt 12; and stepping motors 306 and 307 for moving the sheet pressing levers 300 and 310. The conveyance motor 162 and stepping motor 70 are controlled through motor drivers, and the solenoid 22 is controlled through a solenoid controller. The motor drivers and the solenoid controller are not shown in FIG. 12 (the same is true for the following systems).

The paddle system 149B includes, as input components thereof, a paddle HP sensor 163 for detecting a position of rotation of the paddle 17, and a conveyance roller HP sensor 164 for detecting a position of the conveyance upper roller 19 away from the conveyance lower roller 18, and as an output component, a paddle motor 165 for driving the paddle 17.

The stapling/folding system 149C includes, as input components thereof, a staple HP sensor 166 for detecting a completion of preparation of the head assembly 31 and the anvil assembly 32 for driving and folding a staple; a staple sensor 167 for detecting that a staple is set in the head assembly 31; a staple slide HP sensor 168 for detecting that the head assembly 31 and anvil assembly 32 are placed at the initial positions thereof in the sheet conveyance direction; a pushing plate HP sensor 169 for detecting the home position of the pushing plate 55; a clock sensor 171 for detecting the direction of rotation of the stapling/folding motor 170 to switch the rotation thereof to switch between staple unit driving and folding unit driving; and a safety switch 172 for detecting that the stapler unit 30 and folding unit 50 are enabled for operation.

The stapling/folding system 149C also includes, as output components thereof, the stapler slide motor 42 for rotating the guide screw shaft 36 to drive the head assembly 31 and anvil assembly 32 in a direction perpendicular to the sheet conveyance direction; and a stapling/folding motor 170 for driving the coupling device 44 of the stapler unit 30 in the forward rotation, and driving the coupling device 137 of the folding unit 50 in the reverse rotation.

The alignment system 149D includes, as input components, a forward alignment HP sensor 151 and backward alignment HP sensor 152 for detecting the home position of the alignment plates 9 to align both edges of the sheet on the process tray 8, and as an output component, forward and backward alignment motors 14 for moving the alignment plates 9. In the alignment motors 14, it is possible to set an amount of shifting in a direction perpendicular to the sheet and sheet stack conveyance direction.

The lifting tray system 149E includes, as an output component, the lifting tray motor 155 for moving the lifting tray 90, and as input components, the sheet surface sensor 93 for detecting the surface of the top sheet on the lifting tray 90, a lift clock sensor 150 for detecting an amount of rotation of the lifting tray motor 155, and upper limit switch 153 and lower limit switch 154 for limiting a range of lifting motion of the lifting tray 90.

The sheet detector system 149F includes a lifting tray sheet sensor 156 for detecting the sheet stack on the lifting tray 90 and that the lifting tray 90 and folded sheet stack discharge stacker 80 hold the sheet or the sheet stack, and a folded sheet stack sensor 157 for detecting the sheet stack on the folded sheet stack discharge stacker 80. The sensors 157 and 158 detect the sheet in the sheet post-processing device 2 to alert an operator to the presence of the sheet or the sheet stack when the sheet stack remains at startup or the sheet stack is not removed for a predetermined period.

The door status detector system 149G detects the status of a door attached to the device frame 2A, and determines whether the sheet post-processing device 2 can be mounted to the digital copying apparatus main unit 1. The door status detector system 149G includes a front door sensor 158 and joint switch 159 for detecting whether the sheet post-processing device 2 is properly attached on the digital copying apparatus main unit 1.

The selection switch system 149H includes, as input components, a stapler selection switch 935 for selecting a stitching process to be performed on the sheet stack regardless of whether the stitching process is for saddle stitching or side stitching; a side stitched/unstitched sheet discharge tray selection switch 936 for selecting the discharging of a side stitched sheet or unstitched sheet to the lifting tray 90; and a saddle stitched and folded sheet discharge tray selection switch 937 for selecting the discharging of saddle stitched and folded sheets (stack of sheets) to the folded sheet stack discharge stacker 80. Although the touch panel 248 is used to select the process mode, the user may manually press one of these switches to select a desired process mode while visually checking the selected mode.

An operation of the digital copying apparatus 1A of the embodiment will be explained. The digital copying apparatus main unit 1 and sheet post-processing device 2 will be separately described.

When a sheet feed signal is output from the controller 950 according to an operational direction through the touch panel 248, the sheet is supplied from the sheet feeder 909. A register roller 901 corrects skew of the sheet, and is then fed to the image forming assembly 902 after the timing is adjusted. The controller 950 allows the laser unit 922 to direct a laser beam to the photoconductive drum 914 one line at a time in accordance with the image per one document sheet.

The primary charging unit 919 charges the photoconductive drum 914 in advance, and the laser beam forms an electrostatic latent image on the photoconductive drum 914. The electrostatic latent image is developed into a toner image on the photoconductive drum 914 by the development unit 915.

In the image forming assembly 902, the toner image on the photoconductive drum 914 is transferred to the supplied sheet by the transfer unit 916. The sheet having the toner image is charged by the separating charging unit 917 into a polarity opposite to that of the transfer unit 916, and is then separated from the photoconductive drum 914. The sheet separated from the photoconductive drum 914 is conveyed to the fixing unit 904 by the endless conveyance belt 920. The transferred image is thus permanently fixed onto the sheet by the fixing unit 904. The image is thus formed (recorded) on the sheet.

In the both-side printing mode, the image is formed on the other side of the sheet using the duplexer 921. The discharge roller pair 905 discharges the sheet having the image into the sheet post-processing device 2 from the digital copying apparatus main unit 1. In this way, the images are formed on the sheets fed from the sheet feeder 909, and the sheets having the image are successively discharged into the sheet post-processing device 2.

Typical sheet post-processing modes of the sheet post-processing device 2 include (1) a non-stapling mode in which the sheet stack is placed on the lifting tray 90 without performing the stitching operation thereon, (2) a side stapling mode in which the sheet stack is placed on one of the lifting tray 90 and box-like stack container 88 after performing the stitching operation at least one position at an edge portion of the sheet stack in the direction of conveyance, (3) a saddle stitching mode in which the stitching operation is performed at least at one position at half-way point across the length of the sheet in the sheet conveyance direction, the stitched sheet stack is folded at the folded position into a booklet, and the booklet is collected on the folded sheet stack discharge stacker 80, and (4) an offset mode in which the stitching operation and/or the folding operation is performed on a predetermined position of the sheet stack with the edge of the sheets successively offset (described later). An operation of the sheet post-processing device 2 in these modes will be explained below. The operator selects these modes through the touch panel 147 to store in the RAM in the control unit 149.

When the non-stapling mode is selected, the controller 149 activates the stepping motor 70, thereby moving the pushing claw 13 from the HP position shown in FIG. 4 to a pre-home position (hereinafter referred to as PreHP position) to function as a sheet collection reference on the process tray 8. The conveyance upper roller 19 then stays at the spaced position, and the stopper 21 stays at the retraction position. As shown in FIG. 6, the PreHP position is spaced apart from the HP position of the pushing claw 13 by a distance (L2+α), and is closer to the lifting tray 90 by a distance a than the contact point Q between the conveyance lower roller 18 and conveyance upper roller 19. The movement by the distance (L2+α) is detected by counting the number of steps of the stepping motor 70.

Concurrently, the controller 149 activates the conveyance motor 162, thereby rotating the driving rollers of the conveyance roller pair 5 and discharge roller pair 6 until the sheet is discharged from the discharge roller pair 905 in the digital copying apparatus main unit 1. When the sheet is discharged from the digital copying apparatus main unit 1, the conveyance roller pair 5 and discharge roller pair 6 convey the sheet to the process tray 8. When the sheet detector sensor 4 detects the sheet, the controller 149 measures start timings of the alignment motor 14 for moving the alignment plates 9 and paddle motor 165 for rotating the paddle 17. The controller 149 receives information about the size of the sheet and the direction of the sheet with respect to the conveyance direction from the controller 950 of the digital copying apparatus main unit 1 beforehand, and stores the information in the RAM.

When the sheet is discharged into the process tray 8, the alignment motor 14 and paddle motor 165 are activated. In response, the alignment plates 9 move in the width direction perpendicular to the sheet conveyance direction to align both edges of the sheet. The paddle 17 rotates so that the edge of the sheet is aligned against the end face of the pushing claw 13 already situated at the PreHP position. These steps of the operation are repeated each time when each sheet is discharged into the process tray 8.

When a predetermined number of the sheets are aligned against the end face of the pushing claw 13, the conveyance motor 162 and paddle motor 165 are stopped. The stepping motor 70 is activated to move the conveyance belt 12, so that the end face of the pushing claw 13 pushes the sheets toward the lifting tray 90 (in the arrow direction A in FIGS. 2 and 4). The sheet stacks are collected on the lifting tray 90. Since the distance L1 is smaller than the distance L2 as shown in FIG. 4, the end face of the pushing claw 13 in a vertical state pushes the edge of the sheet stack toward the lifting tray 90, thereby eliminating extra stress in the sheet stack during the movement.

When the sheet stack is placed on the lifting tray 90, the controller 149 allows the lifting tray motor 155 to rotate, thereby lowering the lifting tray 90 by a certain distance. The controller 149 then allows the lifting tray motor 155 to rotate in a reverse direction, thereby raising the lifting tray 90 to a position where the sheet surface sensor 93 detects the surface of the top sheet of the stack. The lifting tray 90 remains at this position until the next sheet stack is placed.

In the non-stapling mode requiring no stitching process, the sheet stack aligned at the PreHP position of the pushing claw 13 is pushed toward the lifting tray 90 without conveying the sheets to the restraining position of the stopper 21. Therefore, even if the digital copying apparatus main unit 1 discharges the sheets at a high discharge rate, the sheet post-processing device 2 keeps pace with the discharge rate.

When the PreHP position of the pushing claw 13 overlaps the conveyance path guide 7 above an upper edge of the pushing claw 13, it is possible to reliably stack the sheets successively brought in one by one along the end face of the pushing claw 13.

When the side stapling is selected, the controller 149 activates the stapler slide motor 42 to move the head assembly 31 and anvil assembly 32 to the initial position to be detected by the staple slide HP sensor 168. The controller 149 turns on the solenoid 22, thereby placing the stopper 21 at the restraining position.

The controller 149 activates the conveyance motor 162, thereby rotating the conveyance roller pair 5 and discharge roller pair 6 to discharge the sheet into the process tray 8 from the digital copying apparatus main unit 1. The alignment motor 14 and paddle motor 165 are then activated. The alignment plates 9 align both sides of the sheet in the width direction, and then the sheet is stopped when the edge of the sheet abuts against the sidewall of the leg of the stopper 21. This step is repeated by a predetermined number of times so that the stopper 21 restrains the sheet stack.

In the state that the sheet stack is restrained by the stopper 21, the conveyance upper roller 19 is shifted toward the conveyance lower roller 18 to nip the sheet stack. The solenoid 22 is turned off to move the stopper 21 to the retraction position thereof. The stepping motor 70 rotates by a predetermined number of steps in a direction opposite to the direction thereof in the non-stapling mode.

In response to the rotation, the conveyance upper roller 19 and conveyance lower roller 18 with the sheet stack nipped therebetween convey the sheet stack in the arrow direction B in FIG. 2 toward the stapler unit 30 until the stitching position of the sheet stack reaches a head position of the head assembly 31 at an initial position.

The one-way clutch 75 (see FIG. 3) is interposed between the first pulley shaft 10*a* and first pulley 10 where the conveyance belt 12 is placed. When the stepping motor 70 rotates in the reverse direction in this way, the rotation of the stepping motor 70 is not transferred to the conveyance belt 12, and the conveyance belt 12 and pushing claw 13 remain stationary due to the one-way clutch 75.

The controller 149 activates the stapling/folding motor 170, thereby allowing the head assembly 31 and anvil assembly 32 to perform the stitching operation on the edge portion of the sheet stack. When the stitching operation is performed at a plurality of positions, the controller 149 activates the stapler slide motor 42 to move the stapler unit 30 and then the stitching operation is performed.

When the stitching operation is completed, the stepping motor 70 drives the conveyance lower roller 18, conveyance upper roller 19, and conveyance belt 12 toward the lifting tray 90. Subsequent to the stitching operation, the sheet stack is handed over to the pushing claw 13 from the conveyance lower roller 18 and conveyance upper roller 19.

The pushing claw 13 pushes and places the sheet stack on the lifting tray 90. The remaining operation of the side stapling mode is the same as that of the non-stapling mode, and the further explanation thereof is omitted.

When the saddle stitching mode is selected, the sheet discharged from the digital copying apparatus main unit 1 is placed on the process tray 8 as in the side stapling standard mode. After being aligned and placed on the process tray 8, the conveyance upper roller 19 is lowered to nip the sheet stack with the conveyance lower roller 18. The solenoid 22 is turned off to move the stopper 21 to the retraction position.

The stepping motor 70 is rotated in a direction opposite to that in the non-stapling mode. The sheet stack nipped between the conveyance upper roller 19 and conveyance lower roller 18 is conveyed toward the stapler unit 30. In this state, the head assembly 31 and anvil assembly 32 remain stationary at the initial positions thereof in a direction perpendicular to the sheet conveyance direction.

When the edge detector sensor 54 detects the forward edge of the sheet stack after the sheet stack is conveyed, the controller 149 conveys the sheet stack in accordance with information about the length of the sheet in the sheet conveyance direction received from the digital copying apparatus main unit 1 and stored in the RAM, until the center of the sheet in the sheet conveyance direction reaches a stitching position. The stepping motor 70 then stops.

The stapling/folding motor 170 drives the head driving shaft 38 and anvil driving shaft 37 in the operational directions thereof to perform the stitching operation. When the stitching operation is performed at a plurality of the stitching positions, the stapler slide motor 42 is activated. With the guide screw shafts 35 and 36 rotating, the head assembly 31 and anvil assembly 32 are moved to a predetermined position in a direction perpendicular to the sheet conveyance direction, and then a stitching operation is performed. When the sheet stack is conveyed to the stitching position, the forward edge of the sheet stack has already passed the stack conveyance upper roller 51 in the folding unit 50 at the spaced position away from the stack conveyance lower roller 52.

To perform the folding operation, the conveyance motor 162 is rotated in a reverse direction to rotate the upper roller movement cam 68 (see FIGS. 7(A) and 7(B)). The stack conveyance upper roller 51 is then lowered toward the stack conveyance lower roller 52 through the bearing holder 102. The sheet stack is thus nipped by means of the pulling spring 104. The conveyance upper roller 19 is moved to the spaced position to release the sheet stack.

Then, the conveyance motor 162 is activated to rotate the stack conveyance upper roller 51 and stack conveyance lower roller 52 to convey the sheet stack further in a downstream direction. During the conveyance, the controller 149 slows and then stops the conveyance motor 162 in accordance with a signal detected by the edge detector sensor 54 and sheet length information stored in the RAM so that a center point of the sheet in the sheet conveyance direction, i.e., the stitching point, is situated at the folding position. In this state, the forward edge of the sheet stack is suspended in the sheet stack passage 58 with the stack nipped between the stack conveyance upper roller 51 and stack conveyance lower roller 52 (see FIG. 2 and FIGS. 13(A) and 13(B)).

The stapling/folding motor 170 rotates in a direction opposite to that for the stitching operation. As shown in FIG. 7(B) and FIG. 8, the folding rollers 57*a* and 57*b* are arranged so that the first quadrant and the fourth quadrant face each other at the initial position where the folding process on the sheet stack Sa is started. As shown in FIG. 9(B) and FIG. 13(B), the folding rollers 57*a* and 57*b* rotate in a direction to nip the sheet stack Sa, and the pushing plate 55 is lowered. In synchronization with the lowering movement of the pushing plate 55, the backup guides 59*a* and 59*b* move to expose the circumferences of the folding rollers 57*a* and 57*b* toward the sheet stack Sa. When the pushing plate 55 is lowered, the sheet stack Sa is nipped and wound between the folding rollers 57*a* and 57*b*. The pushing plate 55 then moves away from the sheet stack Sa, and the sheet stack Sa is further folded between the folding rollers 57*a* and 57*b* (i.e., conveyed in the nipped state).

The sheet stack Sa conveyed in the nipped state is then discharged into and stocked on the folded sheet stack discharge stacker 80. With the folded sheet pressure member 81 pressing the sheet stack Sa, the folded sheet stack (a booklet) does not interfere with the next booklet.

After the folding operation starts, when the pushing plate HP sensor 169 detects that the pushing plate 55 moves reciprocally by the length of the sheet stack Sa in the sheet conveyance direction by a predetermined number of times, the controller 149 stops the stapling/folding motor 170. After the time elapse from the start of the folding operation until the sheet stack Sa is nipped between the folding rollers 57*a* and 57*b*, the stack conveyance upper roller 51 is raised and spaced apart from the stack conveyance lower roller 52 to be ready for an entry of the next sheet stack.

After pushing the sheet stack Sa between the folding rollers 57*a* and 57*b*, the pushing plate 55 moves to the pushing position again for folding the sheet stack Sa. The timing of sheet folding between the folding rollers 57*a* and 57*b* and the timing of movement of the pushing plate 55 are set so that the pushing plate 55 does not contact both edges of the folded sheet stack Sa when the pushing plate 55 moves again to the pushing position. With this arrangement, even when the common driver, i.e. the stapling/folding motor 170, drives the pushing plate 55 and the folding rollers 57*a* and 57*b*, the sheet stack Sa is not damaged. Furthermore, the sheet post-processing device 2 can be made small.

A concept of the offset mode will be described next. In the offset mode, the paddle 17, stopper 21, conveyance lower roller 18, and conveyance upper roller 19 work in cooperation so that the edges of the sheets S in the sheet conveyance direction discharged from the discharge roller pair 6 are successively shifted on the process tray 8 and first stack guide 27. The stapler unit 30 and/or folding unit 50 perform the stitching process and/or folding process at a predetermined stitching position and/or folding position.

Figure 14:
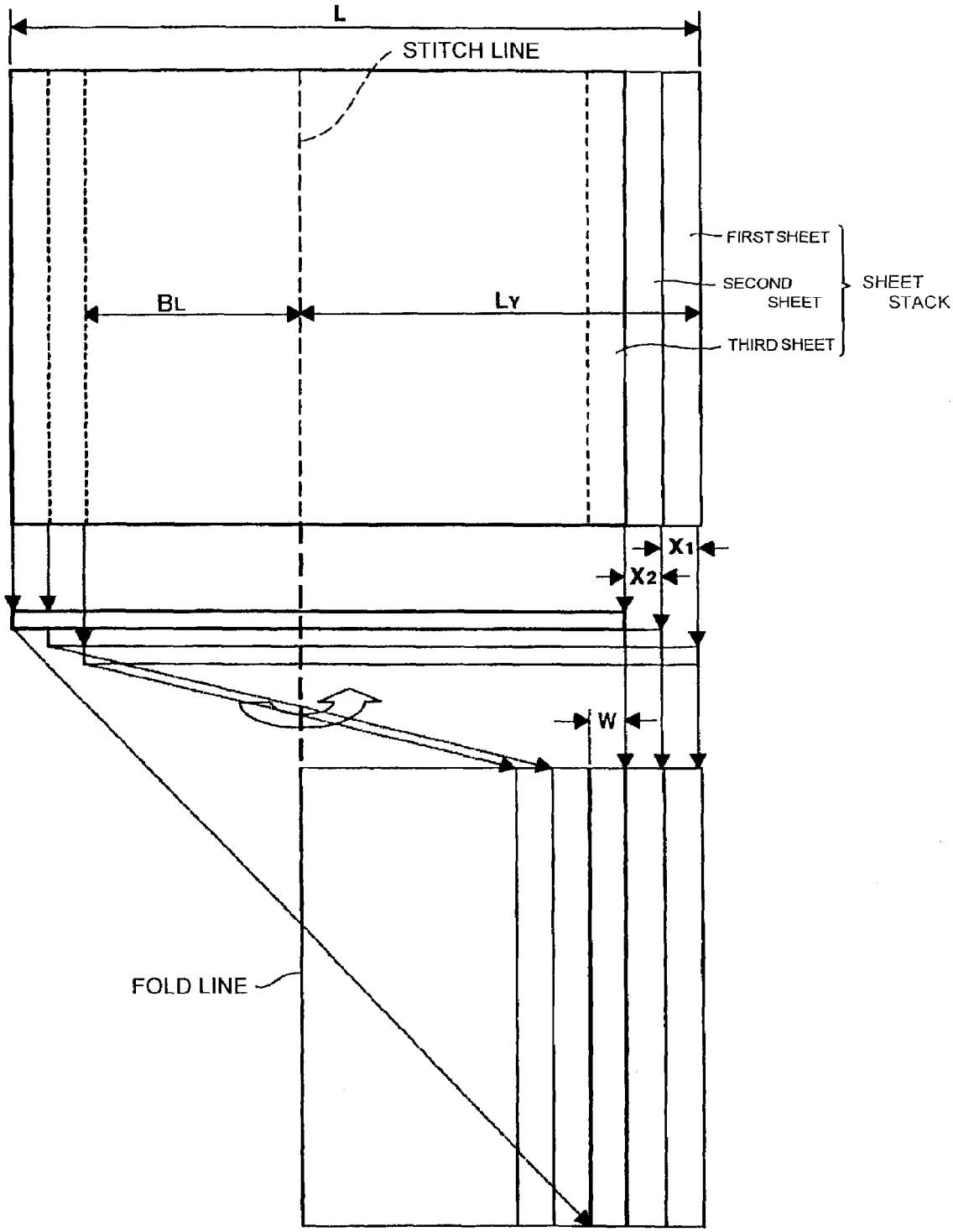
FIG. 14 is a view schematically illustrating the sheet stack in an offset state, and a stitching position and a folding position of the sheet stack.

As shown in FIG. 14, a sheet stack is formed of three sheets, i.e. the first sheet as the outermost page during the folding process, the third sheet as the innermost page during the folding process, and the second sheet as a page in between. A shift of the second sheet with respect to the first (outer) sheet is defined as $X_1$, a shift of the third sheet with respect to the second sheet is defined as $X_2$, and likewise a shift of a Y-th sheet with respect to a (Y−1)-th sheet is defined as $X_{y-1}$. Also, a shift between edges facing each other when the innermost Y-th sheet is folded is defined as W, and L (common size) represents a length of the sheet. A folding position $L_Y$ from the edge of the first sheet, namely, the outermost sheet, is defined by the following equation. A stitching position $L_Y$ from the edge of the first sheet, namely, the outermost sheet, is also defined by the following equation.

$$L_Y = \frac{L+W}{2} + (X1 + X2 + \ldots + X_{Y-1}) \quad (1)$$

In the offset mode, when viewed from above or below the sheet stack, the edges of the sheets are successively shifted so that each edge is visible. In the case that the stitching process is performed, the stitching position $L_Y$ is set at a position $((L-L_Y)<L_Y)$ closer to one end of the sheet stack (the left side in FIG. 14) than to the other end of the sheet stack (the right side in FIG. 14). In the case that the folding process is performed, the edge of the innermost sheet remain visible after the folding process.

The offset modes include three modes, namely, (A) an offset saddle stitch mode in which the stitching process is performed at the stitching position $L_Y$ and the folding process is performed at the folding position $L_Y$, (B) an offset stapling mode in which the stitching process is performed at the stitching position but no folding process is performed, and (C) an offset saddle mode in which the folding process is performed at the folding position but no stitching process is performed.

The operator selects one of the offset modes, and inputs values of the shifts X and W through the touch panel 147. For the sake of explanation, these modes will be explained in the case that the operator inputs a value a as a default value of the shifts X and W ($X_1=X_2= \ldots =X_{Y-1}=a$).

When the offset saddle stitching mode is selected, the controller 149 activates the stapler slide motor 42 to move the head assembly 31 and anvil assembly 32 to the initial position to be detected by the staple slide HP sensor 168. The controller 149 turns on the solenoid 22, thereby placing the stopper 21 at the restraining position. The conveyance upper roller 19 is situated at the spaced position.

The controller 149 activates the conveyance motor 162, thereby rotating the conveyance roller pair 5 and discharge roller pair 6, and then waits in the standby state until the discharge roller pair 905 of the digital copying apparatus main unit 1 discharges the sheet. When the sheet is discharged from the digital copying apparatus main unit 1, the conveyance roller pair 5 and discharge roller pair 6 convey the sheet to the process tray 8. When the sheet detector sensor 4 detects the first sheet, the controller 149 measures start timings of the alignment motor 14 for moving the alignment plates 9 and paddle motor 165 for rotating the paddle 17.

Figure 15A:
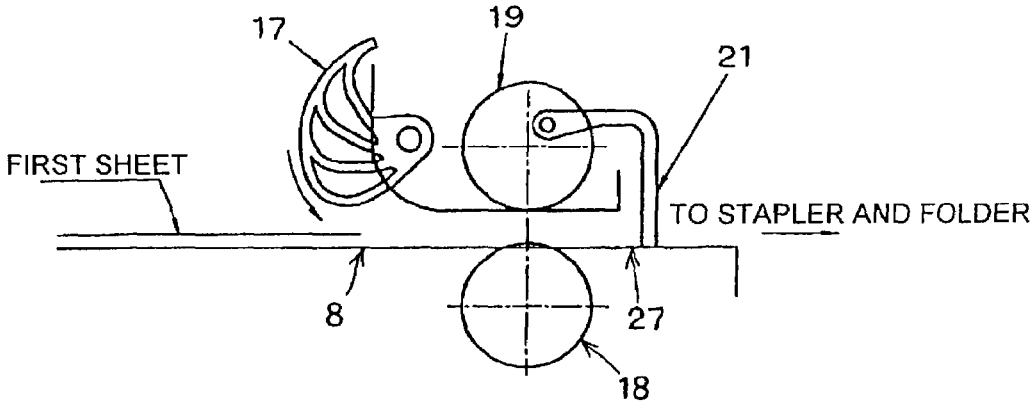

As shown in FIG. 15(A), when the first sheet is discharged to the process tray 8, the alignment motor 14 and paddle motor 165 are activated. In response, the alignment plates 9 move in the width direction perpendicular to the sheet conveyance direction, and align both edges of the sheet. The paddle 17 rotates around the axis 17*a* thereof by one revolution to move the first sheet with the tilted surface of the process tray 8 and first stack guide 27 until the forward edge of the first sheet abuts against the sidewall of the leg of the stopper 21 at the restraining position.

Figure 15B:
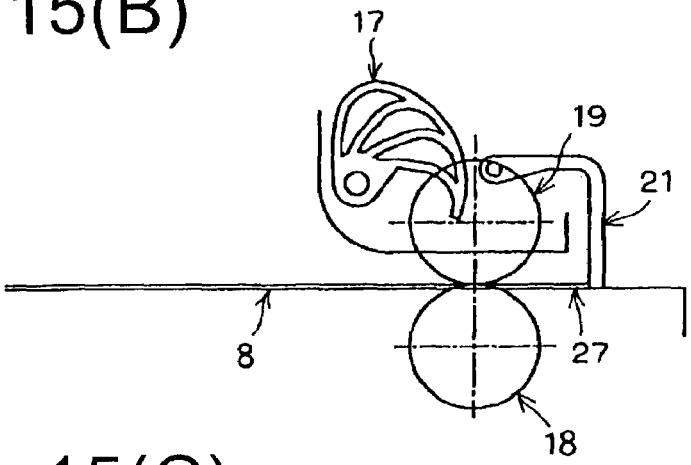
Figure 15C:
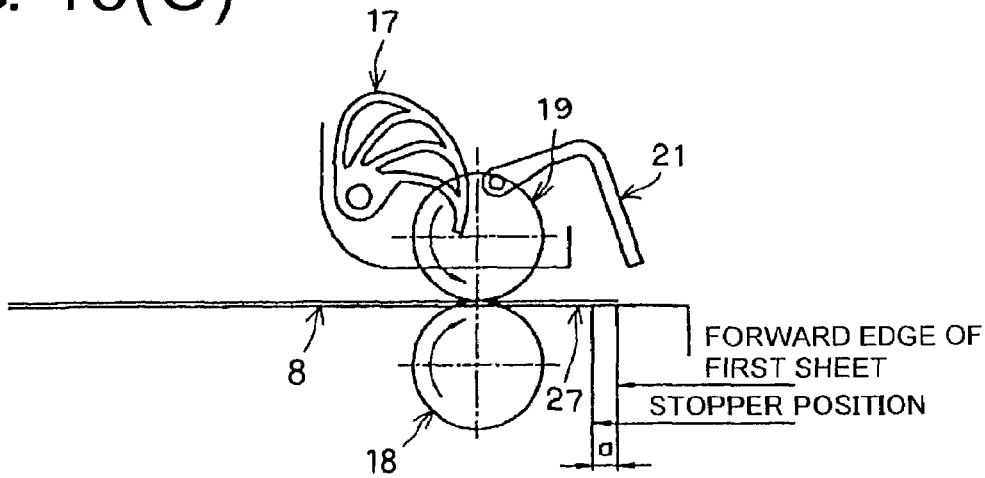

The conveyance upper roller 19 is shifted from the spaced position to the contact position to nip the first sheet with the conveyance lower roller 18 (see FIG. 15(B)). The stopper 21 is then moved to the retraction position. With the stepping motor 70 rotating, the first sheet nipped between the conveyance lower roller 18 and conveyance upper roller 19 is moved toward the stapler unit 30 by an offset of a from the sidewall of the stopper 21 abutting against the forward edges. Then, the stepping motor 70 stops rotating the conveyance lower roller 18 and conveyance upper roller 19 (see FIG. 15(C)).

Figure 16A:
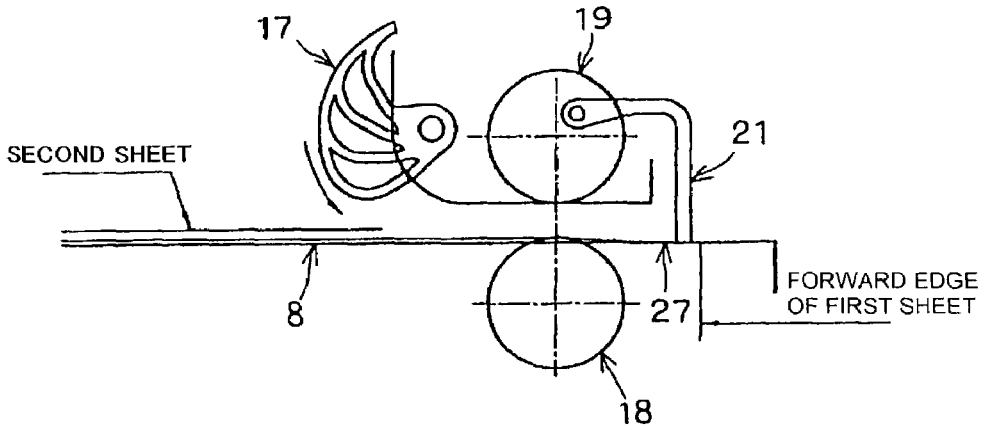

When the solenoid 22 is turned on, the conveyance upper roller 19 is then moved to the spaced position from the contact position thereof with the bottom face of the leg of the stopper 21 pressing the forward edge of the first sheet against the first stack guide 27 serving as a receiver for the n number of the sheets. When the second sheet is discharged into the process tray 8, the paddle motor 165 starts rotating (see FIG. 16(A)).

Figure 16B:
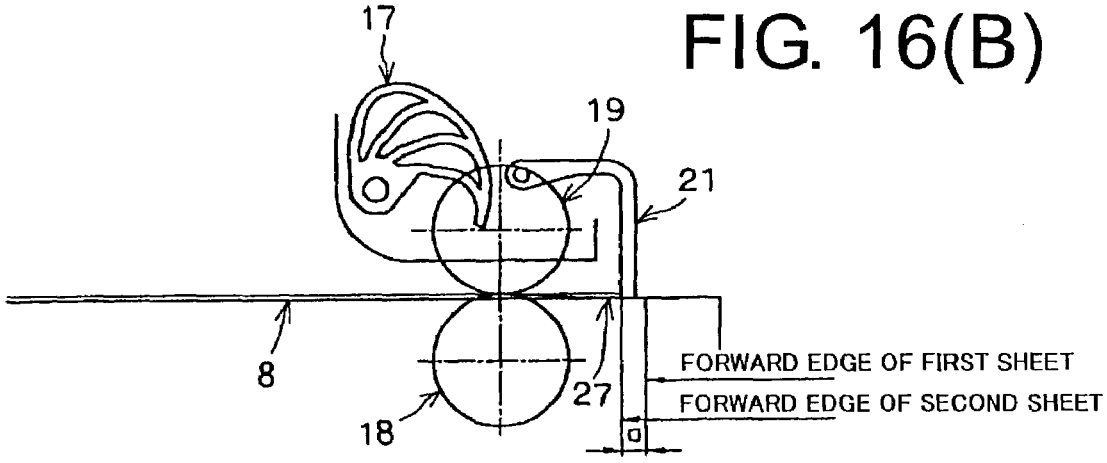

The paddle 17 rotates by one revolution to move the second sheet S to a position where the forward edge of the second sheet S abuts against the sidewall of the leg of the stopper 21 at the restraining position. At this time, there is an offset (shift) of a between the forward edge of the first sheet S and the forward edge of the second sheet S. Then, the conveyance upper roller 19 moves from the spaced position to the contact position to nip the first and second sheets with the conveyance lower roller 18 (see FIG. 16(B)).

Figure 16C:
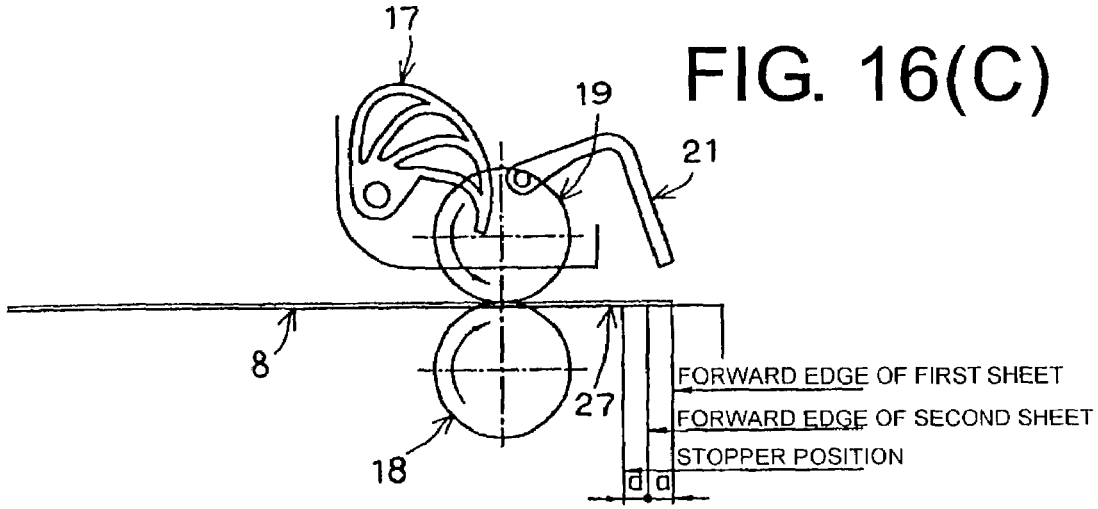

Then, the stopper 21 is moved to the retraction position. The first and second sheets nipped between the conveyance lower roller 18 and conveyance upper roller 19 are moved toward the stapling unit 30 by the offset a from the sidewall of the leg of the stopper 21 abutting against the forward edge of the second sheet. Then, the conveyance lower roller 18 and conveyance upper roller 19 stop rotating (see FIG. 16(C)). In this state, there is the offset a between the forward edge of the first sheet S and the forward edge of the second sheet S, and between the forward edge of the second sheet S and the sidewall of the leg of the stopper 21 where the forward edge of second sheet S abuts.

When the solenoid 22 is turned on, the first and second sheets are pressed with a bottom of the leg of the stopper 21 from above, and the conveyance upper roller 19 moves from the contact position to the spaced position. When the third sheet S is discharged into the process tray 8, the paddle motor 165 starts rotating (FIG. 17(A)).

The paddle 17 rotates around the axis 17*a* by one revolution to move the third sheet S until the forward edge of the third sheet S abuts against the sidewall of the leg of the stopper 21 at the restraining position. The conveyance upper roller 19 moves from the spaced position to the contact position to nip the first, second and third sheets S with the conveyance lower roller 18 (see FIG. 17(B)).

In this state, there is the offset a between the forward edge of the first sheet S and the forward edge of the second sheet S, and between the forward edge of the second sheet S and the sidewall of the leg of the stopper 21 where the forward edge of third sheet S contacts. Similarly, the same offset process is repeated until the Y-th sheet S is processed in response to the input through the touch panel 147 by the operator.

Next, the stepping motor 70 is driven to move the sheet stack nipped between the conveyance upper roller 19 and conveyance lower roller 18 to the stapler unit 30. With this drive, the conveyance upper roller 19 and conveyance lower roller 18 convey the sheet stack to a position where the stitching position $L_Y$ is located at the head position of the head assembly 31 at the initial position while nipping the sheet stack. Then, the conveyance upper roller 19 and conveyance lower roller 18 stop. In this case, the stitching position $L_Y$ with respect to the forward edge of the first sheet is given as $(L+a)/2+\{a\times(Y-1)\}$ by substituting $X_1=X_2=\ldots=X_{Y-1}=W=a$ in Equation (1). The position information is then stored in the RAM as the folding position $L_Y$ after the calculation.

The stapling/folding motor 170 drives the head driving shaft 38 and anvil driving shaft 37 in the operational directions to perform the stitching operation. When the stitching operation is performed at several stitching positions, the stapler slide motor 42 is activated. The guide screw shafts 35 and 36 rotate to move the head assembly 31 and anvil assembly 32 to a predetermined position in a direction perpendicular to the sheet conveyance direction, and then the stitching operation is performed.

Then, to perform the folding operation, the conveyance motor 162 rotates in the reverse direction to rotate the upper roller movement cam 68 as in the saddle stitching mode. The stack conveyance upper roller 51 is lowered toward the stack conveyance lower roller 52 through the bearing holder 102. The sheet stack is thus nipped by the pulling spring 104. The conveyance upper roller 19 in the process tray 8 moves to the spaced position to release the sheet stack.

Figure 18A:
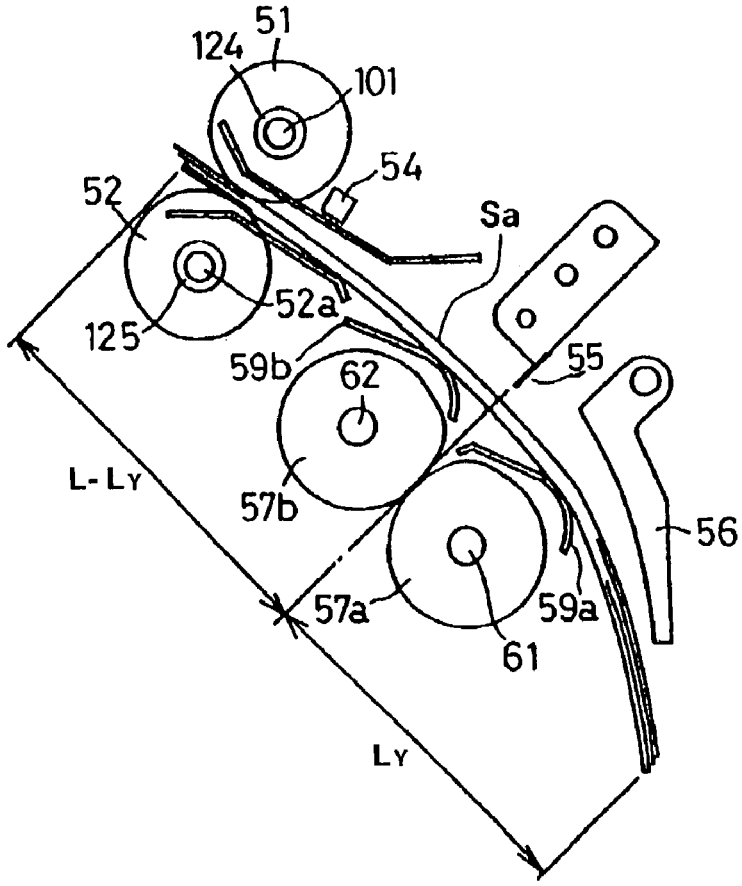

The conveyance motor 162 rotates the stack conveyance upper roller 51 and stack conveyance lower roller 52 to convey the sheet stack further in a downstream direction. During the conveyance, the control unit 149 slows and then stops the conveyance motor 162 in accordance with a signal detected by the edge detector sensor 54 and the information of the folding position $L_Y$ stored in the RAM so that the sheet stack is folded at the folding position $L_Y$. In this state, the forward edge of the sheet stack is suspended in the sheet stack passage 58 while nipped between the stack conveyance upper roller 51 and stack conveyance lower roller 52 (see FIG. 18(A)).

Figure 18B:
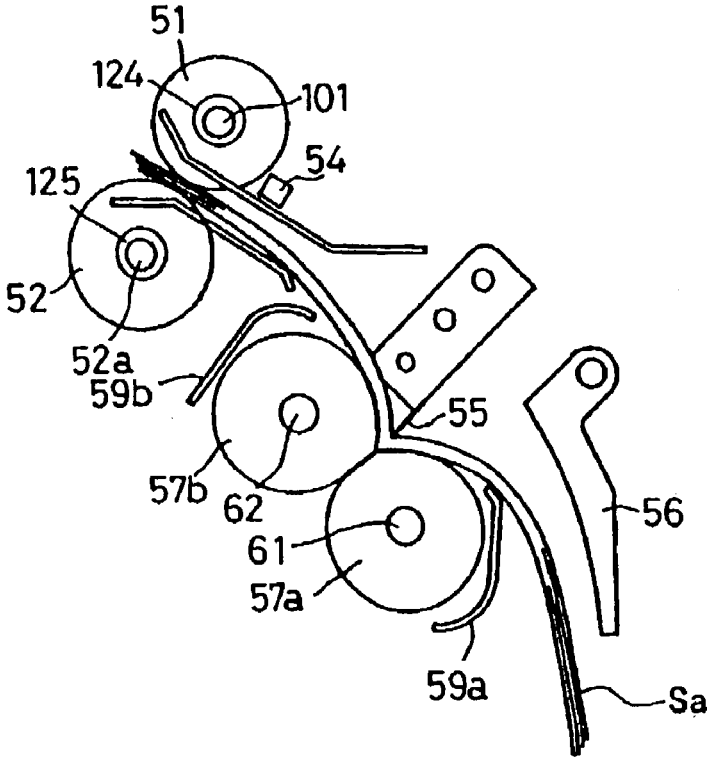

The stapling/folding motor 170 rotates in a direction opposite to that for the stitching operation. As shown in FIG. 18(B), the folding rollers 57*a* and 57*b* rotate in a direction to nip the sheet stack Sa while the pushing plate 55 is lowered. In synchronization with the lowering operation of the pushing plate 55, the backup guides 59*a* and 59*b* move to expose the circumferences of the folding rollers 57*a* and 57*b* toward the sheet stack Sa. When the pushing plate 55 is lowered, the sheet stack Sa is pulled between the folding rollers 57*a* and 57*b*. The pushing plate 55 moves away from the sheet stack Sa, and the sheet stack Sa is further folded between the folding rollers 57*a* and 57*b*.

The sheet stack Sa conveyed in the nipped state between the folding rollers 57*a* and 57*b* is then discharged into and stocked on the folded sheet stack discharge stacker 80. With the folded sheet pressure member 81 pressing the sheet stack Sa, the folded sheet stack (the booklet) is not opened and does not interfere with the next booklet.

After the start of the folding operation, when the pushing plate HP sensor 169 detects that the pushing plate 55 moves back and forth by a predetermined number of times according to the length of the sheet stack Sa in the sheet conveyance direction, the control unit 149 stops the stapling/folding motor 170. After the sheet stack Sa is nipped between the folding rollers 57*a* and 57*b*, the stack conveyance upper roller 51 is raised and spaced apart from the stack conveyance lower roller 52 to be ready for the next sheet stack.

In the offset saddle stitching mode, after pushing the sheet stack Sa into the folding rollers 57*a* and 57*b*, the pushing plate 55 moves to the pushing position again. The timing of folding the sheets between the folding rollers 57*a* and 57*b* and the timing of movement of the pushing plate 55 are set so that the pushing plate 55 does not contact both edges of the folded sheet stack Sa when the pushing plate 55 moves again to the pushing position. Therefore, even if the common driver, i.e. the stapling/folding motor 170, drives the pushing plate 55 and the folding rollers 57*a* and 57*b*, the sheet stack Sa is not damaged. Furthermore, the sheet post-processing device 2 can be made compact.

When the offset stapling mode is selected, the control unit 149 performs the offset process and stitching process as in the offset saddle stitching mode. When the stitching operation is completed, the stepping motor 70 drives the conveyance lower roller 18, conveyance upper roller 19, and conveyance belt 12 toward the lifting tray 90 as in the offset saddle stitching mode (unlike the offset saddle stitching mode in which the sheet stack is folded and moved to the folding unit 50). Accordingly, a pushing pawl 13 pushes and places the sheet stack on the lifting tray 90 after the stitching operation. The remaining operation of the offset stapling mode is the same as that of the non-stapling mode, thus the explanation thereof is omitted.

When the offset saddle mode is selected, the control unit 149 performs the offset process as in the offset saddle stitching mode. When the offset process is completed, the control unit 149 activates the stepping motor 70 to convey the sheet stack nipped between the conveyance upper roller 19 and conveyance lower roller 18 toward the folding unit 50. In parallel, the conveyance motor 162 rotates in the reverse direction to rotate the upper roller movement cam 68. The stack conveyance upper roller 51 is then lowered toward the stack conveyance lower roller 52 through the bearing holder 102. The sheet stack is thus nipped by the pulling spring 104. Then, the conveyance upper roller 19 in the process tray 8 is raised from the sheet stack, thereby releasing the sheet stack.

The conveyance motor 162 is activated to rotate the stack conveyance upper roller 51 and stack conveyance lower roller 52 to convey the sheet stack further in a downstream direction. During the conveyance, the control unit 149 slows and then stops the conveyance motor 162 in accordance with a signal detected by the edge detector sensor 54 and information of the folding position $L_Y$ stored in the RAM so that the sheet stack is folded at the folding position $L_Y$ (see FIG. 18(A)).

The stapling/folding motor 170 rotates in a direction opposite to that for the stitching operation. As shown in FIG. 17(B), the folding rollers 57*a* and 57*b* rotate in a direction to nip the sheet stack Sa, and the pushing plate 55 is lowered. In synchronization with the lowering operation of the pushing plate 55, the backup guides 59*a* and 59*b* move to expose the circumferences of the folding rollers 57*a* and 57*b* toward the sheet stack Sa. When the pushing plate 55 is lowered, the sheet stack Sa is pulled between the folding rollers 57*a* and 57*b*. The pushing plate 55 moves away from the sheet stack Sa, and the sheet stack Sa is further folded between the folding rollers 57*a* and 57*b*.

The sheet stack Sa conveyed in the nipped state between the folding rollers 57*a* and 57*b* is then discharged into and stocked on the folded sheet stack discharge stacker 80. With the folded sheet pressure member 81 pressing the sheet stack Sa, the folded sheet stack without the stitching is not opened and does not interfere with the next booklet.

After the start of the folding operation, when the pushing plate HP sensor 169 detects that the pushing plate 55 moves back and forth by a predetermined number of times according to the length of the sheet stack Sa in the sheet conveyance direction, the control unit 149 stops the stapling/folding motor 170. After the sheet stack Sa is nipped between the folding rollers 57*a* and 57*b*, the stack conveyance upper roller 51 is raised and moves away from the stack conveyance lower roller 52 to be ready for the next sheet stack.

Hereunder, advantages of the digital copying apparatus 1A of the embodiment of the present invention will be explained.

In the digital copying apparatus 1A (sheet post-processing apparatus 2) according to the invention, as shown in FIGS. 7(A), 7(B) and FIG. 8, the folding rollers 57*a* and 57*b* have two curved portions having curve a radius of 40 mm and three curved portions having a curve radius of 10 mm therebetween the two curved portions at the first quadrant and fourth quadrant, respectively. The first and the fourth quadrants are set to face each other at the initial position to start the folding operation on the sheet stack Sa. Therefore, when nipping the sheet stack Sa to perform the folding operation, it is possible to narrow the distance to pull the sheet stack Sa in (see FIG. 7(A)) and to increase the angle to pull the sheet stack at the curved portions having the smaller curve radius (see FIG. 7(B)). Therefore, it is possible to securely nip and fold the sheet stack Sa pushed by the pushing plate 55.

The leading edge of the sheet stack Sa pushed by the pushing plate 55 has a predetermined width. As described above, the folding rollers 57*a* and 57*b* narrows the distance to pull in the sheet stack Sa, so it is possible for the folding rollers 57*a* and 57*b* to move the nipping point P for nipping the sheet stack Sa from the contact point P' between the rotational centers of the folding rollers 57*a* and 57*b* toward the sheet stack Sa pushed by the pushing plate 55 to securely pull in the sheet stack Sa. As a result, it is possible to prevent a folding jam when the sheet stack does not completely convey through the folding rollers with a fixed radius such in a conventional digital copying apparatuses (sheet post-processing devices).

According to the digital copying apparatus (sheet post-processing device) of the present embodiment, it is possible to securely fold the sheet stack, thereby providing a highly reliable digital copying apparatus (sheet post-processing device) Furthermore, with the sheet post-processing apparatus according to the present embodiment, the folding rollers 57*a* and 57*b* have a non-circular section. Thus, the rollers do not need to have a large diameter, thereby making the sheet post-processing apparatus compact.

As shown in FIGS. 15(A), 15(C) through FIGS. 17(A), 17(B), the edge of the sheet S is shifted one by one in the process of forming the sheet stack. The sheets S are thus reliably and precisely shifted without being influenced by a difference in friction between the sheets S.

Alternatively, the edges of all the sheets in the sheet stack may be restrained and aligned by the stopper, and the edges of the sheets are then shifted using a cylinder for shifting the edges. In this mechanism, however, it is difficult to shift the sheets S uniformly because of the difference in friction between the sheets, thereby being inferior to the offset mechanism of the present invention.

In the sheet post-processing device 2 of the present invention, all the sheets on the process tray 8 and the first stack guide 27 are held by the stopper 21 at the restraining position when the paddle 17 urges the second and subsequent sheets S toward the stopper 21. At that time, the conveyance upper roller 19 remains at the spaced position to allow the paddle 17 to urge the sheets S toward the stopper 21. If all the sheets on the process tray 8 and the first stack guide 27 remains in a non-held state, the offset posture of all the sheets will be destroyed. The stopper 21 holds all the sheets on the process tray 8 and the first stack guide 27, the posture of the shifted sheets is maintained, thereby preventing the destruction of the offset posture of the sheet stack and booklet.

In the offset process of the embodiments, the conveyance lower roller 18 and conveyance upper roller 19 have the function of conveying the sheet stack toward the stapler unit 30, as well as the function of shifting the sheet stack by the shift a. Further, the stopper 21 has the function of pressing the sheet stack from above with the bottom thereof, as well as the function of restraining the sheets S with the sidewall of the stopper 21, thereby reducing the number of the parts in the offset unit 20. Therefore, it is possible to make the offset unit 20 and the sheet post-processing device 2 small.

In the embodiments, the digital copying apparatus 1A includes the digital copying apparatus main unit 1 with the sheet post-processing device 2 attached thereto. The invention is also applicable to a sheet post-processing device commercially available as a separate unit to achieve the same advantages. The sheet post-processing device is provided with an interface for sending a control signal such as of sheet size information from a control unit of a digital copying apparatus to a control unit of the sheet post-processing device.

In the embodiments, the operator inputs the value of the shift using the touch panel 147 of the sheet post-processing device 2. Alternatively, the operator may input the value of the shift using an operation unit (not shown) of the digital copying apparatus main unit 1. In this case, the ROM of the control unit 950 in the digital copying apparatus main unit 1 may store the same program and data as those of the control unit 149 in the sheet post-processing device 2. Alternatively, a portion of the program and data may be sent to the control unit 950 through an interface after turning on the control unit 149.

For the sake of the explanation, the operator inputs the default shift value a through the touch panel 147, and the control unit 149 calculates the folding position $L_Y$ and the stitching position $L_Y$. It is possible to create a table based on a plurality of the shifts and the folding positions $L_Y$ and/or the stitching position $L_Y$ in advance. According to a selected shift (distance of travel), the folding position $L_Y$ and/or the stitching position $L_Y$ may be read from the table. The shift is thus easily set or modified by storing such a table in a memory.

In the embodiments, the sheet post-processing device 2 includes both the stapler unit 30 and folding unit 50. It is also possible to obtain the booklet when the sheet post-processing device 2 includes at least one of the stapler unit 30 and folding unit 50. Specifically, it is acceptable to manually staple the folded booklet. Without one of the stapler unit 30 and folding unit 50, the sheet post-processing device 2 becomes compact and less expensive.

In the embodiments, the sheets S are shifted in the sheet conveyance direction on the process tray 8 and first stack guide 27. Alternatively, the sheets S may be shifted in a direction perpendicular to the sheet conveyance direction. It is also perfectly acceptable that the sheets S are shifted in both the sheet conveyance direction and the direction perpendicular to the sheet conveyance direction, thereby making it easy to turn the pages of such a booklet.

Further, in the embodiments described above, the first stack guide 27 and process tray 8 are two separate parts. Alternatively, the process tray 8 may extend to one side (toward the stapler unit 30) by a length corresponding to the first stack guide 27.

Furthermore, in the present embodiments, the unit frame 49 is provided with the guide hole 64, and the folding roller drive shaft 62 is pulled by the pulling spring 67 to vary the distance between the folding rollers 57*a* and 5*b* (their folding roller drive shafts 61 and 62) having the non-circular section. Alternatively, the folding roller drive shaft 62 is shifted off relative to the folding roller 57*b*, and the pulling spring 67 pulls the folding roller holder 63 to vary the distance between the folding rollers 57*a* and 57*b* (their folding roller drive shafts 61 and 62) having the non-circular section.

Furthermore, in the embodiments, the roller drive shaft 61 is fixed and the roller drive shaft 62 is movable to vary the distance between the folding rollers 57*a* and 57*b*. It is also possible to move the roller drive shaft 61 and fix the roller drive shaft 62.

In the embodiments, both of the folding rollers 57*a* and 57*b* have the non-circular section. Alternatively, it is possible that only one of the rollers has the non-circular section, namely the folding roller 57*b* has a non-circular section and the folding roller 57*a* has a circular section, to narrow the distance between the folding rollers 57*a* and 57*b*. The same effect of the pair of the folding rollers described herein can be achieved to securely pull in the sheet stack Sa.

As described above, according to the present invention, the pair of the folding rotating bodies move the folding position from the contact point between the rotational centers to the sheet stack pushed by the pushing means. Therefore, the sheet stack is more easily pulled in between the pair of the folding rollers, thereby securing the folding process by the folding rollers on the sheet stack.

While the invention has been explained with specific embodiments of the invention, the explanation is illustrative and the invention is limited only by the appended claims.

What is claimed is:

1. A sheet post-processing apparatus for post-processing a sheet, comprising:

conveying means for conveying a sheet stack in a conveyance direction;

pushing means for pushing, at a predetermined position, the sheet stack in a direction substantially perpendicular to the conveyance direction ; and a pair of rotating bodies with smooth surfaces disposed adjacent to the pushing means and rotated in opposite directions for drawing therebetween the sheet stack pushed by the pushing means at a folding portion and folding the sheet stack, each of said pair of rotating bodies having at least two curved portions having different curvatures for drawing the sheet stack from a contact point between rotational shafts of the pair of the rotating bodies when the sheet stack is being folded, wherein the at least two curved portions comprise a first curvature portion having a first radius and a second curvature portion having a second radius less than the first radius, and join continuously around a periphery of the rotating body from the first curvature portion to the second curvature portion so that the sheet stack contacts the first curvature portions and then the second curvature portions and is folded between the first curvature portions and then between the second curvature portions.

2. A sheet post-processing apparatus according to claim 1, wherein said pair of the rotating bodies moves the folding portion in the direction that the pushing means pushes the sheet stack.

3. A sheet post-processing apparatus according to claim 1, wherein said pair of the rotating bodies is rotatably supported such that a distance between the rotational shafts of the pair of the rotating bodies is variable.

4. A sheet post-processing apparatus according to claim 1, wherein each of said pair of the rotating bodies is rotatably supported on an eccentric shaft so that a distance between the eccentric shaft and a rotational shaft of the pair of the rotating bodies is variable.

5. An image forming apparatus comprising an image forming device for forming an image on the sheet, and the sheet post-processing apparatus according to claim 1 for folding the sheet with the image formed thereon by the image forming device.

6. A sheet post-processing apparatus according to claim 1, wherein a distance between the rotational shafts of the pair of the rotating bodies is changed when the sheet stack is being folded.

7. A sheet post-processing apparatus according to claim 1, wherein said second curvature portion projects outwardly from the first curvature portion.

8. A sheet post-processing apparatus according to claim 7, wherein said first and second curvature portions are arranged such that when the sheet stack is started to be folded, the first curvature portions of the rotating bodies face each other to form the contact point therebetween and the second curvature portions of the rotating bodies face each other adjacent the pushing means to reduce a space between the rotating bodies from the contact point to the second curvature portions.

9. A sheet post-processing apparatus according to claim 8, wherein each of said first and second curvature portions extends substantially along an entire axial direction of the rotating body.

* * * * *